US011426998B2

(12) United States Patent
Murayama

(10) Patent No.: US 11,426,998 B2
(45) Date of Patent: Aug. 30, 2022

(54) LIQUID EJECTION HEAD UNIT, LIQUID EJECTION APPARATUS, AND LIQUID EJECTION STATE DETERMINATION METHOD OF LIQUID EJECTION APPARATUS

(71) Applicant: SEIKO EPSON CORPORATION, Tokyo (JP)

(72) Inventor: Toshiro Murayama, Fujimi-Machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/236,296

(22) Filed: Apr. 21, 2021

(65) Prior Publication Data

US 2021/0331467 A1 Oct. 28, 2021

(30) Foreign Application Priority Data

Apr. 24, 2020 (JP) ..... JP2020-077197

(51) Int. Cl.
*B41J 2/14* (2006.01)
*B41J 29/38* (2006.01)

(52) U.S. Cl.
CPC ..... *B41J 2/14032* (2013.01); *B41J 29/38* (2013.01); *B41J 2002/14354* (2013.01); *B41J 2002/14419* (2013.01); *B41J 2202/12* (2013.01)

(58) Field of Classification Search
CPC .... B41J 29/38; B41J 2/04563; B41J 2/14032; B41J 2/18; B41J 2/04581; B41J 2/0451; B41J 2/0458; B41J 2/04588; B41J 2/04541; B41J 2/175; B41J 2002/14354; B41J 2002/14419; B41J 2202/12
See application file for complete search history.

(56) References Cited

U.S. PATENT DOCUMENTS 7,950,758 B2 * 5/2011 Yoshida ..... B41J 2/04593 347/9
8,104,860 B2 * 1/2012 Ito ..... B41J 2/04541 347/19
9,463,619 B2 * 10/2016 Mitsuki ..... B41J 2/04581
2013/0233939 A1 9/2013 Uezawa

FOREIGN PATENT DOCUMENTS

JP 2011-189655 A 9/2011
JP 2013-184372 A 9/2013

* cited by examiner

*Primary Examiner* — An H Do
(74) *Attorney, Agent, or Firm* — Workman Nydegger

(57) ABSTRACT

A liquid ejection head unit includes a first energy generating element that generates energy that applies pressure to a liquid in the first pressure chamber; a second energy generating element that generates energy that applies pressure to a liquid in the second pressure chamber; a nozzle flow path which communicates the first pressure chamber and the second pressure chamber and in which a nozzle that ejects a liquid is provided; a drive circuit that drives the first energy generating element and the second energy generating element by applying a drive pulse; a detection circuit that detects a parameter related to a physical property of a liquid in the second pressure chamber; wherein a controller drives the first energy generating element by the drive circuit, and performs a first detection operation of detecting the parameter in the second pressure chamber by the detection circuit.

20 Claims, 14 Drawing Sheets

LIQUID EJECTION HEAD UNIT, LIQUID EJECTION APPARATUS, AND LIQUID EJECTION STATE DETERMINATION METHOD OF LIQUID EJECTION APPARATUS

The present application is based on, and claims priority from JP Application Serial Number 2020-077197, filed Apr. 24, 2020, the disclosure of which is hereby incorporated by reference herein in its entirety.

BACKGROUND

1. Technical Field

The present disclosure relates to a liquid ejection head unit, a liquid ejection apparatus, and a method of determining a liquid ejection state of the liquid ejection apparatus.

2. Related Art

For example, as disclosed in JP-A-2011-189655, a liquid ejection apparatus such as an ink jet printer includes a pressure chamber for applying pressure to the liquid, and a piezoelectric element that apply pressure to the pressure chamber. The apparatus described in JP-A-2011-189655 detects a residual vibration waveform based on the vibration of ink after supplying a drive signal to the pressure element as an electromotive force of the piezoelectric element, and determines the ink state such as ink viscosity or air bubbles based on this detection result.

In the apparatus described in JP-A-2011-189655, since the same piezoelectric element is used for both generation and detection of the residual vibration waveform, it is necessary to switch the piezoelectric element used for detecting the residual vibration waveform from the driving state to the detecting state. Therefore, in the device described in Patent Literature 1, there is a problem that electrical noise generated by the switching is mixed in the residual vibration waveform, and as a result, the determination accuracy of the ejection state is lowered.

SUMMARY

According to an aspect of the present disclosure, a liquid ejection head unit includes a first pressure chamber that applies pressure to a liquid, a second pressure chamber that applies pressure to a liquid, a first energy generating element that generates energy that applies pressure to a liquid in the first pressure chamber, a second energy generating element that generates energy that applies pressure to a liquid in the second pressure chamber, a nozzle flow path which communicates the first pressure chamber and the second pressure chamber and in which a nozzle that ejects a liquid is provided, a drive circuit that drives the first energy generating element and the second energy generating element by applying a drive pulse, a detection circuit that detects a parameter related to a physical property of a liquid at least in the second pressure chamber, and a controller that controls an operation of the drive circuit and an operation of the detection circuit, wherein the controller drives the first energy generating element by the drive circuit, and performs a first detection operation of detecting the parameter in the second pressure chamber by the detection circuit.

According to an aspect of the present disclosure, a liquid ejection apparatus includes the liquid ejection head unit according to the previous aspect, and a transport mechanism that transports a print medium on which an image by a liquid from the liquid ejection head unit is printed.

According to an aspect of the present disclosure, in a method of determining a liquid ejection state of a liquid ejection apparatus including a first pressure chamber that applies pressure to a liquid, a second pressure chamber that applies pressure to a liquid, a first energy generating element that generates energy that applies pressure to a liquid in the first pressure chamber, a second energy generating element that generates energy that applies pressure to a liquid in the second pressure chamber, and a nozzle flow path which communicates the first pressure chamber and the second pressure chamber and in which a nozzle that ejects a liquid is provided, the method includes driving the first energy generating element to detect a parameter related to a physical property of a liquid in the second pressure chamber accompanying a drive of the first energy generating element, and determining an ejection state of a liquid from the nozzle based on the parameter and the physical property.

DESCRIPTION OF EXEMPLARY EMBODIMENTS

Figure 1:
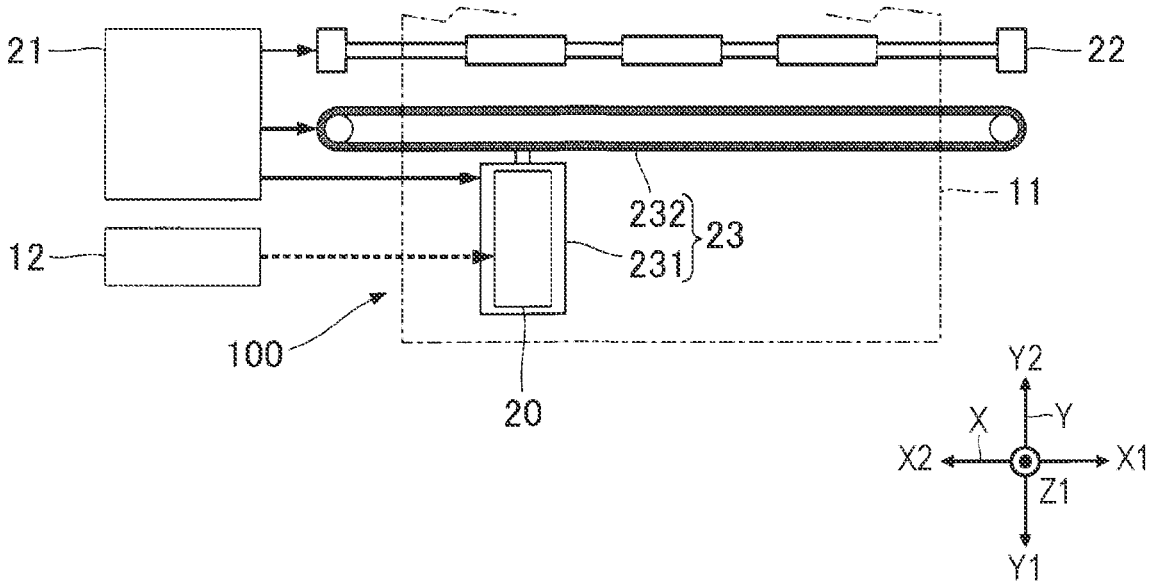
FIG. 1 is a schematic diagram showing a configuration example of a liquid ejection apparatus according to the first embodiment.

Hereinafter, preferred embodiments according to the present disclosure will be described with reference to the accompanying drawings. In the drawings, the dimensions or scales of each part are appropriately different from the actual ones, and some parts are schematically shown for easy understanding. Further, the scope of the present disclosure is not limited to these forms unless it is stated in the following description that the present disclosure is particularly limited.

In the following description, the X axis, the Y axis, and the Z axis that intersect each other will be appropriately used. Further, one direction along the X axis is referred to as the X1 direction, and a direction opposite to the X1 direction is referred to as the X2 direction. Similarly, the directions opposite to each other along the Y axis are referred to as the Y1 direction and the Y2 direction. Further, the directions opposite to each other along the Z axis are referred to as the Z1 direction and the Z2 direction. Here, typically, the Z axis is a vertical axis, and the Z2 direction corresponds to a downward direction in the vertical direction. However, the Z axis may not be a vertical axis. The X axis, the Y axis, and the Z axis are typically orthogonal to each other, but are not limited to this, and may intersect at an angle within a range of 80° or more and 100° or less, for example.

A: First Embodiment

A1: Overall Configuration of Liquid Ejection Apparatus

FIG. 1 is a schematic diagram showing a configuration example of a liquid ejection apparatus 100 according to the first embodiment. The liquid ejection apparatus 100 is an ink jet printing device that ejects a liquid such as ink as droplets onto a medium 11. The medium 11 is an example of a print medium, for example, printing paper. The medium 11 is not limited to printing paper, and may be a printing target made of any material such as a resin film or fabric cloth.

A liquid container 12 is attached to the liquid ejection apparatus 100. The liquid container 12 stores ink. Specific forms of the liquid container 12 include, for examples, a cartridge that can be attached to and detached from the liquid ejection apparatus 100, a bag-shaped ink pack made of a flexible film, and an ink tank that can be refilled with ink. Any type of ink is stored in the liquid container 12.

As shown in FIG. 1, the liquid ejection apparatus 100 includes a control module 21, a transport mechanism 22, a movement mechanism 23, and a liquid ejection head module 20. The control module 21 controls the operation of each element of the liquid ejection apparatus 100.

The transport mechanism 22 transports the medium 11 along the Y axis under the control of the control module 21. The movement mechanism 23 reciprocates the liquid ejection head module 20 along the X axis under the control of the control module 21. The movement mechanism 23 includes a substantially box-shaped transport body 231 that accommodates the liquid ejection head module 20, and an endless transport belt 232 to which the transport body 231 is fixed. The number of liquid ejection head modules 20 mounted on the transport body 231 is not limited to one, but may be plural. Further, in addition to the liquid ejection head module 20, the liquid container 12 described above may be mounted on the transport body 231.

Under the control of the control module 21, the liquid ejection head module 20 ejects the ink supplied from the liquid container 12 to the medium 11 from each of the plurality of nozzles. An image is formed on the surface of the medium 11 by performing this ejection with the transport of the medium 11 by the transport mechanism 22 and the reciprocating movement of the liquid ejection head module 20 by the movement mechanism 23 in parallel.

A2: Electrical Configuration of Liquid Ejection Apparatus

Figure 2:
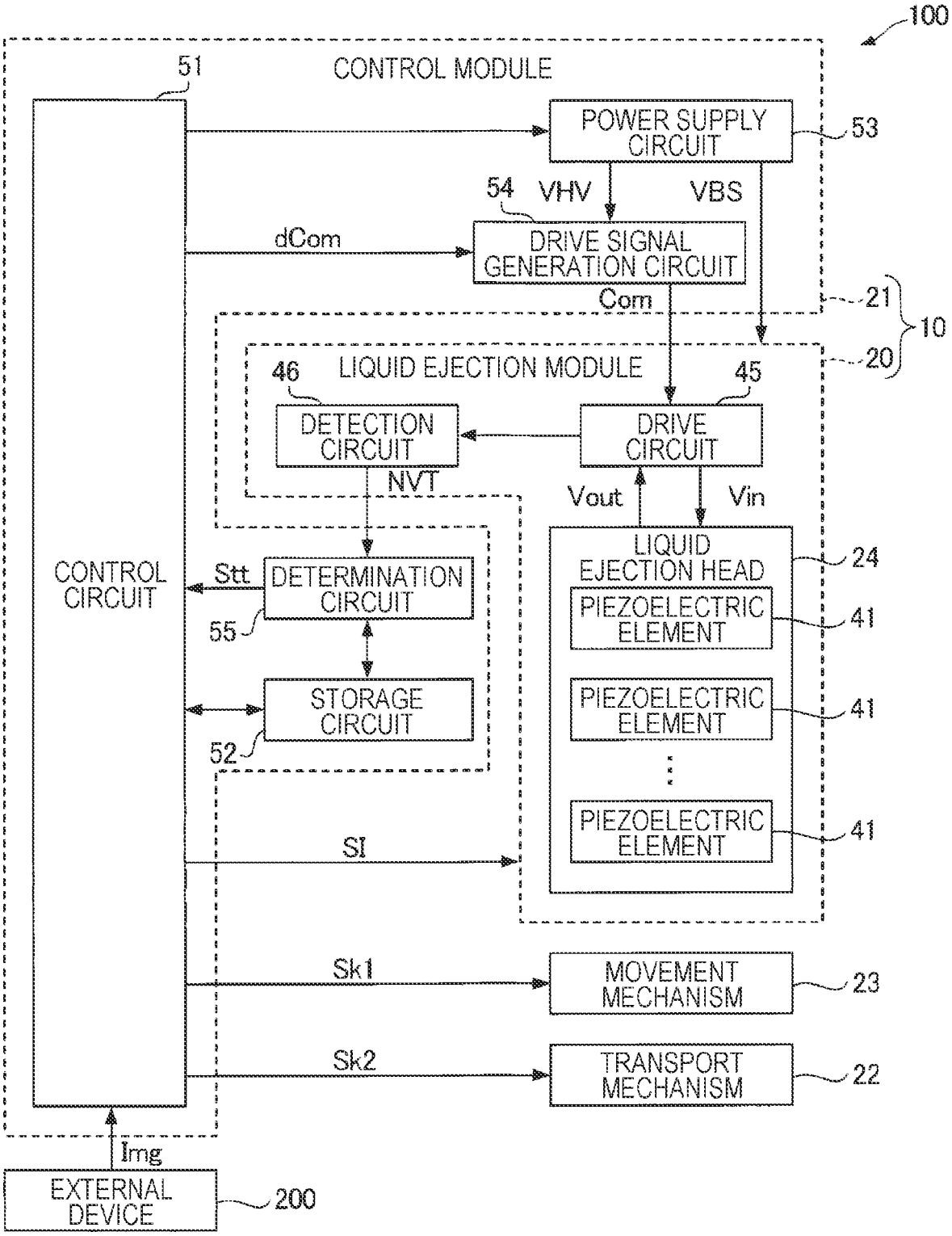
FIG. 2 is a block diagram showing an electrical configuration of the liquid ejection apparatus according to the first embodiment.

FIG. 2 is a block diagram showing an electrical configuration of the liquid ejection apparatus 100 according to the first embodiment. Among the components of the liquid ejection apparatus 100 shown in FIG. 2, the control module 21 and the liquid ejection head module 20 described above constitute the liquid ejection head unit 10.

As shown in FIG. 2, the liquid ejection head module 20 includes a liquid ejection head 24, a drive circuit 45, and a detection circuit 46. The outline of these will be described below. The liquid ejection head 24, the drive circuit 45, and the detection circuit 46 will be described in detail later with reference to FIGS. 3 to 8.

The liquid ejection head 24 includes a plurality of piezoelectric elements 41, and the ink is ejected from the nozzle by appropriately driving the plurality of piezoelectric elements 41. Here, each piezoelectric element 41 has a function of applying pressure to the ink by receiving the supply of a supply drive signal Vin and a function of outputting an output signal Vout by receiving the pressure from the ink.

The drive circuit 45 drives the piezoelectric element 41 under the control of the control module 21. In the present embodiment, the drive circuit 45 also serves as a switching circuit. Specifically, the drive circuit 45 switches under the control of the control module 21 whether to supply a drive signal Com output from the control module 21 as the supply drive signal Vin to each of the plurality of piezoelectric elements 41 included in the liquid ejection head 24. Moreover, in the embodiment, the drive circuit 45 switches under the control of the control module 21 whether to supply the electromotive force of the piezoelectric element 41 as the output signal Vout to the detection circuit 46 for each of the plurality of piezoelectric elements 41 included in the liquid ejection head 24.

The detection circuit 46 detects the parameter related to the physical property of the ink flowing through the flow path provided in the liquid ejection head 24. The physical property of the ink in the embodiment are any value as long as it is possible to determine the ink ejection state described later, but are preferably the viscosity of the ink from the viewpoint of high correlation with the ink ejection state. When the piezoelectric element is used as in the present embodiment, it is preferable to detect the residual vibration described later as a parameter related to the physical property of the ink. The detection circuit 46 of the present embodiment generates a residual vibration signal NVT based on the output signal Vout generated by each piezoelectric element 41. For example, the detection circuit 46 generates the residual vibration signal NVT by amplifying the output signal Vout after removing noise. As will be described in detail later, the residual vibration signal NVT indicates a residual vibration, which is a vibration remaining in the ink flow path in the liquid ejection head 24 after the piezoelectric element 41 is driven.

In the example shown in FIG. 2, although the number of liquid ejection heads 24 included in the liquid ejection head module 20 is one, it is not limited to this. The number of liquid ejection heads 24 included in the liquid ejection head module 20 may be two or more. In the following description, when the number of piezoelectric elements 41 included in the liquid ejection head 24 is M, the piezoelectric element 41 may be referred to as a piezoelectric element 41[*m*] using the subscript [m] in order to distinguish each of the M piezoelectric elements 41. However, M is a natural number of 1 or more, and m is a natural number of 1 or more and M or less. Further, the subscript [m] may also be used for M other components or signals corresponding to the piezoelectric elements 41 in the liquid ejection apparatus 100 to indicate the corresponding relationship with the piezoelectric element 41[*m*].

As shown in FIG. 2, the control module 21 includes a control circuit 51, a storage circuit 52, a power supply circuit 53, a drive signal generation circuit 54, and a determination circuit 55.

The control circuit 51 has a function of controlling the operation of each unit of the liquid ejection apparatus 100 and a function of processing various pieces of data. Here, the control circuit 51 is an example of a controller, and controls the operations of the drive circuit 45 and the detection circuit 46 described above. The control circuit 51 includes a processor such as at least one a central processing unit (CPU). Instead of a CPU, or in addition to the CPU, the control circuit 51 may include a programmable logic device such as a field-programmable gate array (FPGA). When the control circuit 51 is composed of a plurality of processors, for example, the operation control of the drive circuit 45 and the operation control of the detection circuit 46 may be performed by separate processors. In other words, the description that the controller controls the operation of the drive circuit 45 and the operation of the detection circuit 46 is applied to both cases where the operation of the drive circuit 45 and the operation of the detection circuit 46 are performed by the same processor, and where the operation of the drive circuit 45 and the operation of the detection circuit 46 are performed by separate processors. When the control circuit 51 is composed of a plurality of processors, the plurality of processors may be mounted on different substrates or the like.

The storage circuit 52 stores various programs executed by the control circuit 51 and various pieces of data such as print data Img processed by the control circuit 51. The storage circuit 52 includes a semiconductor memory of one or both of, for example, a volatile memory such as a random access memory (RAM) and a nonvolatile memory such as a read only memory (ROM), an electrically erasable programmable read-only memory (EEPROM), or a programmable read only memory (PROM). The print data Img is supplied from an external device 200 such as a personal computer or a digital camera. The storage circuit 52 may be configured as part of the control circuit 51.

The power supply circuit 53 receives power from a commercial power supply (not shown) and generates various predetermined potentials. The various electric potentials generated are appropriately supplied to each unit of the liquid ejection apparatus 100. For example, the power supply circuit 53 generates a power supply potential VHV and an offset potential VBS. The offset potential VBS is supplied to the liquid ejection head module 20. Further, the power supply potential VHV is supplied to the drive signal generation circuit 54.

The drive signal generation circuit 54 is a circuit that generates the drive signal Com for driving each piezoelectric element 41. Specifically, the drive signal generation circuit 54 includes, for example, a DA conversion circuit and an amplifier circuit. In the drive signal generation circuit 54, the DA conversion circuit converts a waveform specification signal dCom from the control circuit 51 from a digital signal to an analog signal, and the amplifier circuit amplifies the analog signal using the power supply potential VHV from the power supply circuit 53 to generate the drive signal Com. Here, among the waveforms included in the drive signal Com, the signal of the waveform actually supplied to the piezoelectric element 41 is the above-mentioned supply drive signal Vin. The waveform specification signal dCom is a digital signal for specifying the waveform of the drive signal Com.

The determination circuit 55 determines the ink ejection state in a nozzle N, which will be described later, based on the residual vibration signal NVT to generate determination information Stt indicating the determination result. The determination information Stt is used, for example, for controlling ink ejection from a nozzle during printing. The determination circuit 55 is an example of the determination unit. The determination circuit 55 may be configured as part of the control circuit 51.

In the above control module 21, the control circuit 51 controls the operation of each unit of the liquid ejection apparatus 100 by executing the program stored in the storage circuit 52. Here, the control circuit 51 executes the program to generate a control signals Sk1 and Sk2, a control signal SI, and the waveform specification signal dCom as signals for controlling the operations of respective units of the liquid ejection apparatus 100.

The control signal Sk1 is a signal for controlling the drive of the transport mechanism 22. The control signal Sk2 is a signal for controlling the drive of the movement mechanism 23. The control signal SI is a digital signal for designating the operating state of the piezoelectric element 41. The control signal SI may include a timing signal for specifying the drive timing of the piezoelectric element 41. The timing signal is generated, for example, based on the output of the encoder that detects the position of the transport body 231 described above.

A3: Flow Path of Liquid Ejection Head

Figure 3:
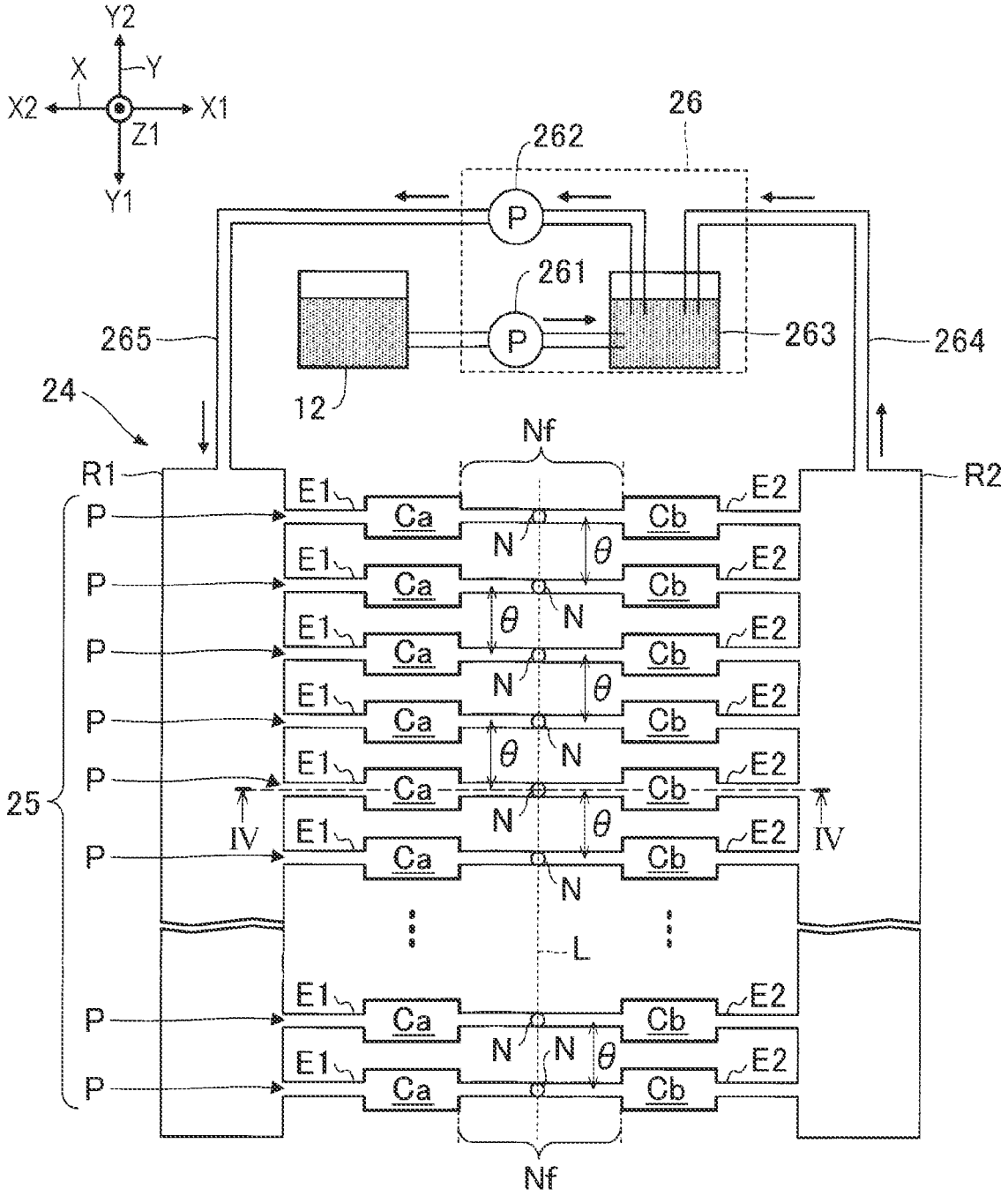
FIG. 3 is a schematic diagram of a flow path in the liquid ejection head according to the first embodiment.

FIG. 3 is a schematic diagram of a flow path in the liquid ejection head 24 according to the first embodiment. As shown in FIG. 3, the liquid ejection head 24 includes a plurality of nozzles N, a plurality of individual flow paths P, a first common liquid chamber R1 and a second common liquid chamber R2, and is coupled to a circulation mechanism 26.

More specifically, the liquid ejection head 24 has a surface facing the medium 11, and as shown in FIG. 3, the plurality of nozzles N is provided on the surface. The plurality of nozzles N is disposed along the Y axis. Each of the plurality of nozzles N ejects the ink in the Z2 direction.

Here, a set of the plurality of nozzles N constitutes a nozzle row L. Further, the plurality of nozzles N is disposed at equal intervals at a pitch θ. The pitch θ is a distance between the centers of the plurality of nozzles N in the direction along the Y axis.

The individual flow path P communicates with each of the plurality of nozzles N. Each of the plurality of individual flow paths P extends along the X axis and communicates with different nozzles N. The set of the plurality of individual flow paths P constitutes a individual flow path row 25. Further, the plurality of individual flow paths P is disposed along the Y axis.

As shown in FIG. 3, each individual flow path P includes a pressure chamber Ca, a pressure chamber Cb, and a nozzle flow path Nf. Here, the pressure chamber Ca is an example of a first pressure chamber. The pressure chamber Cb is an example of a second pressure chamber. Each of the pressure chamber Ca and the pressure chamber Cb in each individual flow path P extends along the X axis, and is a space in which the ink ejected from the nozzle N communicating with the individual flow path P is stored. Therefore, the direction along the X axis is also referred to as the extending direction of the pressure chamber Ca or the extending direction of the pressure chamber Cb. In the example shown in FIG. 3, the plurality of pressure chambers Ca is disposed along the Y axis. Similarly, the plurality of pressure chambers Cb is disposed along the Y axis. Therefore, the direction along the Y axis is also referred to as the array direction of the pressure chamber Ca or the array direction of the pressure chamber Cb. In each individual flow path P, the positions of the pressure chamber Ca and the pressure chamber Cb in the direction along the Y axis are the same in the example shown in FIG. 3, but may be different from each other. Further, in the following, when the pressure chamber Ca and the pressure chamber Cb are not particularly distinguished, they are also simply referred to as a "pressure chamber C".

The nozzle flow path Nf is disposed between the pressure chamber Ca and the pressure chamber Cb in each individual flow path P. In each individual flow path P, the nozzle flow path Nf extends along the X axis and communicates the pressure chamber Ca and the pressure chamber Cb. Further, the plurality of nozzle flow paths Nf is disposed along the Y axis at intervals from each other. The nozzle N is provided in each nozzle flow path Nf. In each nozzle flow path Nf, the ink is ejected from the nozzle N by changing the pressure in the pressure chamber Ca and the pressure chamber Cb described above.

The first common liquid chamber R1 and the second common liquid chamber R2 communicate with the plurality of individual flow paths P. Each of the first common liquid chamber R1 and the second common liquid chamber R2 is a space extending along the Y axis over the entire range in which the plurality of nozzles N is distributed. The above-mentioned individual flow path row 25 and the plurality of nozzles N are located between the first common liquid chamber R1 and the second common liquid chamber R2 in the direction along the Z axis. In the following, viewing in the direction along the Z axis is also referred to as "plan view".

Here, the first common liquid chamber R1 is coupled to an end E1 of each individual flow path P in the X2 direction. The ink that is supplied to each individual flow path P is stored in the first common liquid chamber R1. On the other hand, the second common liquid chamber R2 is coupled to an end E2 of each individual flow path P in the X1 direction. The ink that is discharged from each individual flow path P without being supplied for ejection is stored in the second common liquid chamber R2.

The circulation mechanism 26 is coupled to the first common liquid chamber R1 and the second common liquid chamber R2. The circulation mechanism 26 is a mechanism that supplies the ink to the first common liquid chamber R1 and collecting the ink discharged from the second common liquid chamber R2 for the resupply to the first common liquid chamber R1. The circulation mechanism 26 includes a first supply pump 261 and a second supply pump 262, a storage container 263, a collection flow path 264, and a supply flow path 265.

The first supply pump 261 is a pump that supplies the ink stored in the liquid container 12 to the storage container 263. The storage container 263 is a sub-tank that temporarily stores the ink supplied from the liquid container 12. The collection flow path 264 communicates the second common liquid chamber R2 and the storage container 263, and is a flow path for collecting the ink from the second common liquid chamber R2 into the storage container 263. The ink stored in the liquid container 12 is supplied to the storage container 263 from the first supply pump 261, and the ink discharged from each individual flow path P to the second common liquid chamber R2 is supplied to the storage container 263 through the collection flow path 264. The second supply pump 262 is a pump that delivers the ink stored in the storage container 263. The supply flow path 265 communicates the first common liquid chamber R1 and the storage container 263, and is a flow path for supplying the ink from the storage container 263 to the first common liquid chamber R1.

A4: Specific Structure of Liquid Ejection Head

Figure 4:
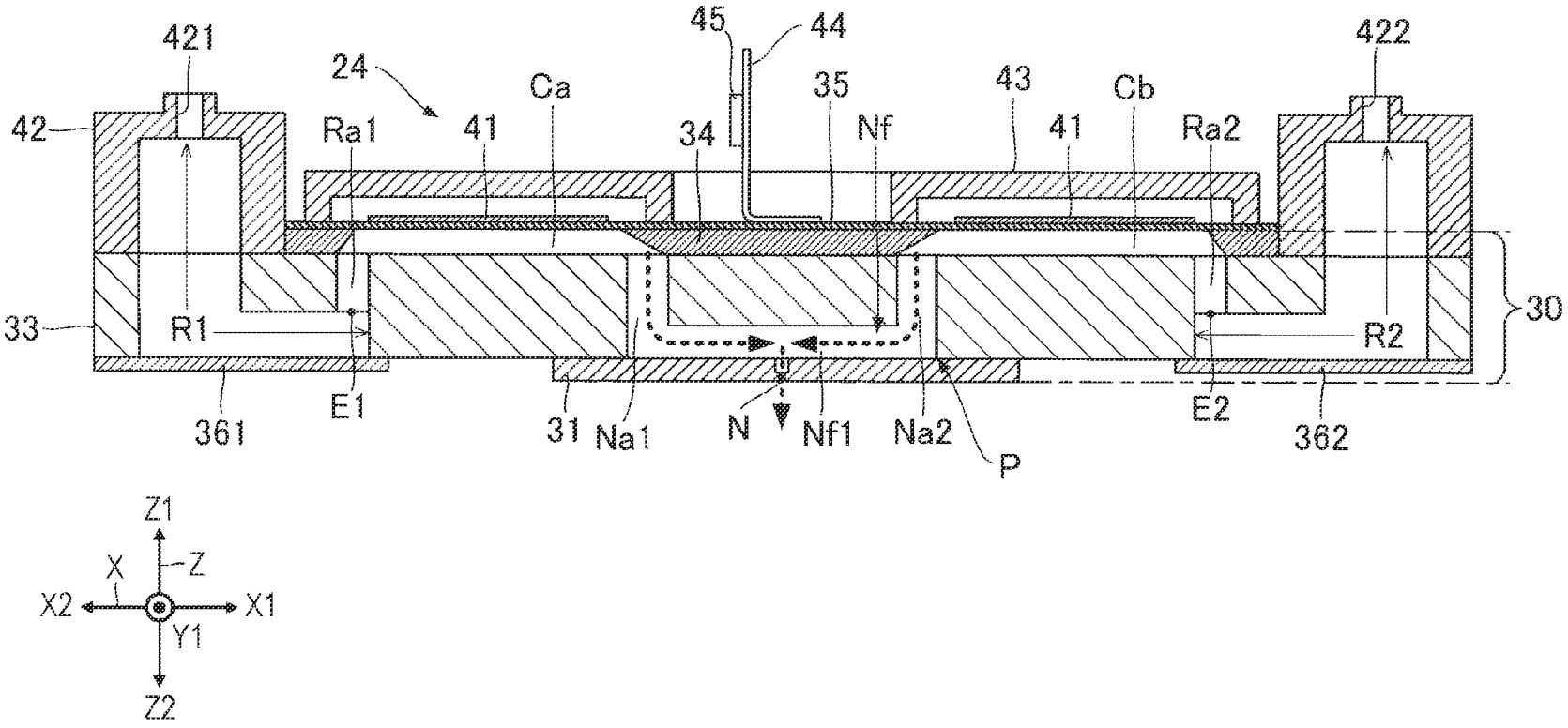
FIG. 4 is a cross-sectional view taken along line IV-IV in FIG. 3.

FIG. 4 is a cross-sectional view taken along line IV-IV in FIG. 3. FIG. 4 shows a cross section of the liquid ejection head 24 cut along the individual flow path P in a plane parallel to the X axis and the Z axis. As shown in FIG. 4, the liquid ejection head 24 includes a flow path structure 30, the plurality of piezoelectric elements 41, a housing 42, a protective substrate 43, and a wiring substrate 44.

The flow path structure 30 includes the first common liquid chamber R1, the second common liquid chamber R2, the plurality of individual flow paths P, and the plurality of nozzles N mentioned above. Specifically, the flow path structure 30 is a structure in which a nozzle substrate 31, a communication plate 33, a pressure chamber substrate 34, and a diaphragm 35 are laminated in this order in the Z1 direction. Each member of the nozzle substrate 31, the communication plate 33, the pressure chamber substrate 34, and the diaphragm 35 extends along the Y axis, and is manufactured, for example, by processing a silicon single crystal substrate using semiconductor processing technology. Further, these members are joined to each other by an adhesive or the like. In addition, another layer such as an adhesive layer or a substrate may be appropriately interposed between two adjacent members among the plurality of members constituting the flow path structure 30.

The plurality of nozzles N is provided on the nozzle substrate 31. Each of the plurality of nozzles N penetrates the nozzle substrate 31 and is a through hole through which the ink passes.

The communication plate 33 has part of each of the first common liquid chamber R1 and the second common liquid chamber R2 and part of the plurality of individual flow paths P excluding the pressure chamber Ca and the pressure chamber Cb. Here, each individual flow path P includes a supply flow path Ra1 and a discharge flow path Ra2 in addition to the pressure chamber Ca, the pressure chamber Cb, and the nozzle flow path Nf described above. Among the components constituting such an individual flow path P, the nozzle flow path Nf, the supply flow path Ra1 and the discharge flow path Ra2 are provided on the communication plate 33.

Part of each of the first common liquid chamber R1 and the second common liquid chamber R2 is a space penetrating the communication plate 33. A vibration absorber 361 and a vibration absorber 362 that close the openings by the space are installed on the face of the communication plate 33 toward the Z2 direction.

Each of the vibration absorber 361 and the vibration absorber 362 is a layered member made of an elastic material. The vibration absorber 361 constitutes part of the wall face of the first common liquid chamber R1 and absorbs the pressure fluctuation in the first common liquid chamber R1. Similarly, the vibration absorber 362 constitutes part of the wall face of the second common liquid chamber R2, and absorbs the pressure fluctuation in the second common liquid chamber R2.

As described above, the nozzle flow path Nf is a space for communicating the pressure chamber Ca and the pressure chamber Cb. In the example shown in FIG. 4, the nozzle flow path Nf includes a horizontal flow path Nf1, a first vertical flow path Na1, and a second vertical flow path Na2.

The horizontal flow path Nf1 is a space in a groove provided on the face of the communication plate 33 toward the Z2 direction. Here, the nozzle substrate 31 constitutes part of the wall face of the horizontal flow path Nf1.

Each of the first vertical flow path Na1 and the second vertical flow path Na2 extends along the Z axis and is a space penetrating the communication plate 33. The first vertical flow path Na1 communicates the pressure chamber Ca with the horizontal flow path Nf1 and guides the ink from the pressure chamber Ca to the horizontal flow path Nf1. On the other hand, the second vertical flow path Na2 communicates the pressure chamber Cb and the horizontal flow path Nf1 and guides the ink from the horizontal flow path Nf1 to the pressure chamber Cb. The first vertical flow path Na1 and the second vertical flow path Na2 may be provided as necessary, and may be omitted. In this case, the horizontal flow path Nf1 constitutes the nozzle flow path Nf that communicates the pressure chamber Ca and the pressure chamber Cb.

Each of the supply flow path Ra1 and the discharge flow path Ra2 extends along the Z axis and is a space penetrating the communication plate 33. The supply flow path Ra1 communicates the first common liquid chamber R1 and the pressure chamber Ca, and supplies the ink from the first common liquid chamber R1 to the pressure chamber Ca. Here, one end of the supply flow path Ra1 opens on the face of the communication plate 33 toward the Z1 direction. On the other hand, the other end of the supply flow path Ra1 is the upstream end E1 of the individual flow path P, and opens on the wall face of the first common liquid chamber R1 at the communication plate 33. On the other hand, the discharge flow path Ra2 communicates the second common liquid chamber R2 and the pressure chamber Cb, and discharges the ink from the pressure chamber Cb to the second common liquid chamber R2. Here, one end of the discharge flow path Ra2 opens on the face of the communication plate 33 toward the Z1 direction. On the other hand, the other end of the discharge flow path Ra2 is the downstream end E2 of the individual flow path P, and opens on the wall face of the second common liquid chamber R2 at the communication plate 33.

The pressure chamber substrate 34 has the pressure chambers Ca and the pressure chambers Cb of the plurality of individual flow paths P. Each of the pressure chamber Ca and the pressure chamber Cb penetrates the pressure chamber substrate 34 and is a gap between the communication plate 33 and the diaphragm 35.

The diaphragm 35 is a plate-shaped member that can vibrate elastically. The diaphragm 35 is a laminate including, for example, a first layer made of silicon oxide ($SiO_2$) and a second layer made of zirconium oxide ($ZrO_2$). Here, another layer such as a metal oxide may be interposed between the first layer and the second layer. Part or all of the diaphragm 35 may be integrally made of the same material as the pressure chamber substrate 34. For example, the diaphragm 35 and the pressure chamber substrate 34 can be integrally formed by selectively removing part, in the thickness direction, of the region, corresponding to the pressure chamber C, of the plate-shaped member having a predetermined thickness. Further, the diaphragm 35 may be composed of a layer of a single material.

The plurality of piezoelectric elements 41 corresponding to different pressure chambers C is installed on the face of the diaphragm 35 toward the Z1 direction. Here, the piezoelectric element 41 corresponding to each pressure chamber Ca is an example of a first energy generating element. The piezoelectric element 41 corresponding to each pressure chamber Cb is an example of a second energy generating element. The piezoelectric element 41 corresponding to each pressure chamber C overlaps the pressure chamber C in plan view. Each piezoelectric element 41 is composed of, for example, a laminate of a first electrode and a second electrode facing each other and a piezoelectric body layer disposed between the two electrodes. Each piezoelectric element 41 ejects the ink in the pressure chamber C from the nozzle N by varying the pressure of the ink in the pressure chamber C. The piezoelectric element 41 vibrates the diaphragm 35 as it deforms when the drive signal Com is supplied. The pressure chamber C expands and contracts with this vibration, so that the pressure of the ink in the pressure chamber C varies.

The housing 42 is a case that stores the ink. The housing 42 has a space forming a rest space other than a partial space provided by the communication plate 33 for each of the first common liquid chamber R1 and the second common liquid chamber R2. Further, the housing 42 has a supply port 421 and a discharge port 422. The supply port 421 is a conduit communicating with the first common liquid chamber R1 and is coupled to the supply flow path 265 of the circulation mechanism 26. Therefore, the ink sent from the second supply pump 262 to the supply flow path 265 is supplied to the first common liquid chamber R1 via the supply port 421. On the other hand, the discharge port 422 is a conduit communicating with the second common liquid chamber R2 and is coupled to the collection flow path 264 of the circulation mechanism 26. Therefore, the ink in the second common liquid chamber R2 is discharged to the collection flow path 264 via the discharge port 422.

The protective substrate 43 is a plate-shaped member installed on the face of the diaphragm 35 toward the Z1 direction, protects the plurality of piezoelectric elements 41, and reinforces the mechanical strength of the diaphragm 35. Here, a space that accommodates the plurality of piezoelectric elements 41 is formed between the protective substrate 43 and the diaphragm 35.

The wiring substrate 44 is mounted on the face of the diaphragm 35 toward the Z1 direction, and is a mounting component for electrically coupling the control module 21 and the liquid ejection head 24. For example, the flexible wiring substrate 44 such as a flexible printed circuit (FPC) or a flexible flat cable (FFC) is preferably used. The drive circuit 45 described above is mounted on the wiring substrate 44. In addition to the drive circuit 45, the detection circuit 46 described above may be mounted on the wiring substrate 44.

Here, the drive circuit 45 is located between the piezoelectric element 41 corresponding to the pressure chamber Ca and the piezoelectric element 41 corresponding to the pressure chamber Cb when viewed in the Z2 direction, which is the ink ejection direction from the nozzle N. In other words, the drive circuit 45 is located between the piezoelectric element 41 corresponding to the pressure chamber Ca and the piezoelectric element 41 corresponding to the pressure chamber Cb in the direction along the X axis. Therefore, the supply path of the drive signal Com from the drive circuit 45 to both of these piezoelectric elements 41 can be shortened, compared with the supply path of the configuration in which the drive circuit 45 is located at another position.

In the liquid ejection head 24 having the above configuration, the ink flows to the first common liquid chamber R1, the supply flow path Ra1, the pressure chamber Ca, the nozzle flow path Nf, the pressure chamber Cb, the discharge flow path Rat, and the second common liquid chamber R2 in this order by the operation of the circulation mechanism 26 described above.

Further, the piezoelectric elements 41 corresponding to both the pressure chamber Ca and the pressure chamber Cb are simultaneously driven by the drive signal Com from the drive circuit 45, to fluctuate the pressure in the pressure chamber Ca and the pressure chamber Cb, so that the ink is ejected from the nozzle N due to the pressure fluctuations. In FIG. 4, when the piezoelectric elements 41 corresponding to both the pressure chamber Ca and the pressure chamber Cb are driven at the same time, the path and direction of the ink flow are indicated by broken lines and arrows. The operation period or operation timing of the circulation mechanism 26 is not limited, and whether it overlaps with the period or timing of ejecting the ink from the nozzle N is also not limited.

As described above, the liquid ejection head unit 10 has the supply flow path Ra1 and the discharge flow path Ra2. As described above, the supply flow path Ra1 communicates with the pressure chamber Ca and supplies the ink to the pressure chamber Ca. The discharge flow path Ra2 communicates with the pressure chamber Cb, and the ink is discharged from the pressure chamber Cb. With the supply flow path Ra1 and the discharge flow path Ra2, it is possible to reduce ink retention in the flow path between the supply flow path Ra1 and the discharge flow path Ra2. Therefore, thickening of ink or precipitation of components in the vicinity of nozzle N can be reduced. As a result, it is possible to prevent deterioration of ejection characteristics such as the amount of ink ejected or the ejection speed of the liquid ejection head 24.

Here, the supply of ink from the supply flow path Ra1 to the pressure chamber Ca and the discharge of ink from the pressure chamber Cb to the discharge flow path Ra2 are performed by the operation of the circulation mechanism 26 as described above. The supply side and the discharge side in the coupling form of the circulation mechanism 26 and the liquid ejection head 24 may be reversed. In this case, the supply flow path Ra1 functions as a discharge flow path to which the ink is discharged from the pressure chamber Ca, and the discharge flow path Ra2 functions as a supply flow path from which the ink is supplied to the pressure chamber Cb.

A5: Details of Drive Circuit

Figure 5:
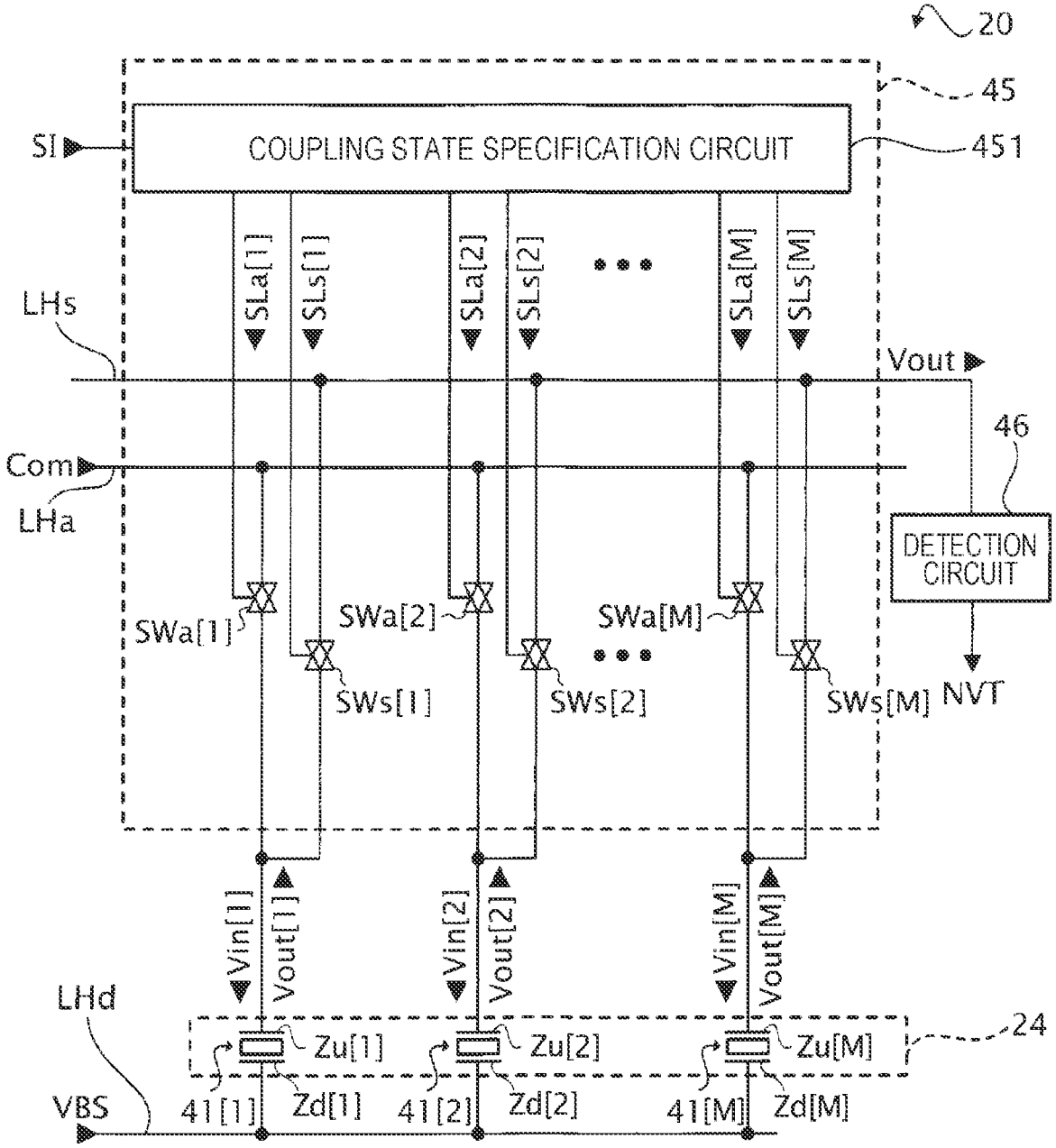
FIG. 5 is a diagram showing a configuration example of a drive circuit according to the first embodiment.

FIG. 5 is a diagram showing a configuration example of the drive circuit 45 according to the first embodiment. As shown in FIG. 5, wirings LHd, LHa and LHs are coupled to the drive circuit 45. The wiring LHd is a power supply line from which the offset potential VBS is supplied. The wiring LHa is a signal line for transmitting the drive signal Com. The wiring LHs are signal line for transmitting the output signal Vout.

The drive circuit 45 includes M switches SWa (SWa[1] to SWa[M]), M switches SWs (SWs[1] to SWs[M]), and a coupling state specification circuit 451 that specifies the coupling state of these switches.

The switch SWa[m] is a switch that switches between conduction (on) and non-conduction (off) between the wiring LHa for transmitting the drive signal Com and the piezoelectric element 41[*m*]. The switch SWs[m] is a switch that switches between conduction (on) and non-conduction (off) between the wiring LHs for transmitting the output signal Vout and the piezoelectric element 41[*m*]. Each of these switches is, for example, a transmission gate. Here, the piezoelectric element 41[1] is a piezoelectric element 41 corresponding to the pressure chamber Ca described above. Further, the piezoelectric element 41[2] is a piezoelectric element 41 corresponding to the pressure chamber Ca described above. In FIG. 5, one of the first electrode and the second electrode of the piezoelectric element 41 described above is indicated as an electrode Zd[m], and the other is indicated as an electrode Zu[m].

The coupling state specification circuit 451 generate coupling state specification signals SLa[1] to SLa[M] that specify on/off of the switches SWa[1] to SWa[M], and coupling state specification signals SLs[1] to SLs[M] that specify on/off of the switches SWs[1] to SWs[M] based on the control signal SI.

The switch SWa[m] is turned on and off according to the coupling state specification signal SLa[m] generated as described above. For example, the switch SWa[m] is turned on when the coupling state specification signal SLa[m] is at high level, and turned off when the coupling state specification signal SLa[m] is at low level. As described above, the drive circuit 45 supplies part or all of the waveform included in the drive signal Com as the supply drive signal Vin to one or a plurality of piezoelectric elements 41 selected from the plurality of piezoelectric elements 41.

Further, the switch SWs[m] is turned on and off according to the coupling state specification signal SLs[m]. For example, the switch SWs[m] is turned on when the coupling state specification signal SLs[m] is at high level, and turned off when the coupling state specification signal SLs[m] is at low level. As described above, the drive circuit 45 supplies the output signal Vout from one or a plurality of piezoelectric elements 41 selected from the plurality of piezoelectric elements 41 to the detection circuit 46.

A6: Ejection Operation of Liquid Ejection Apparatus

Figure 6:
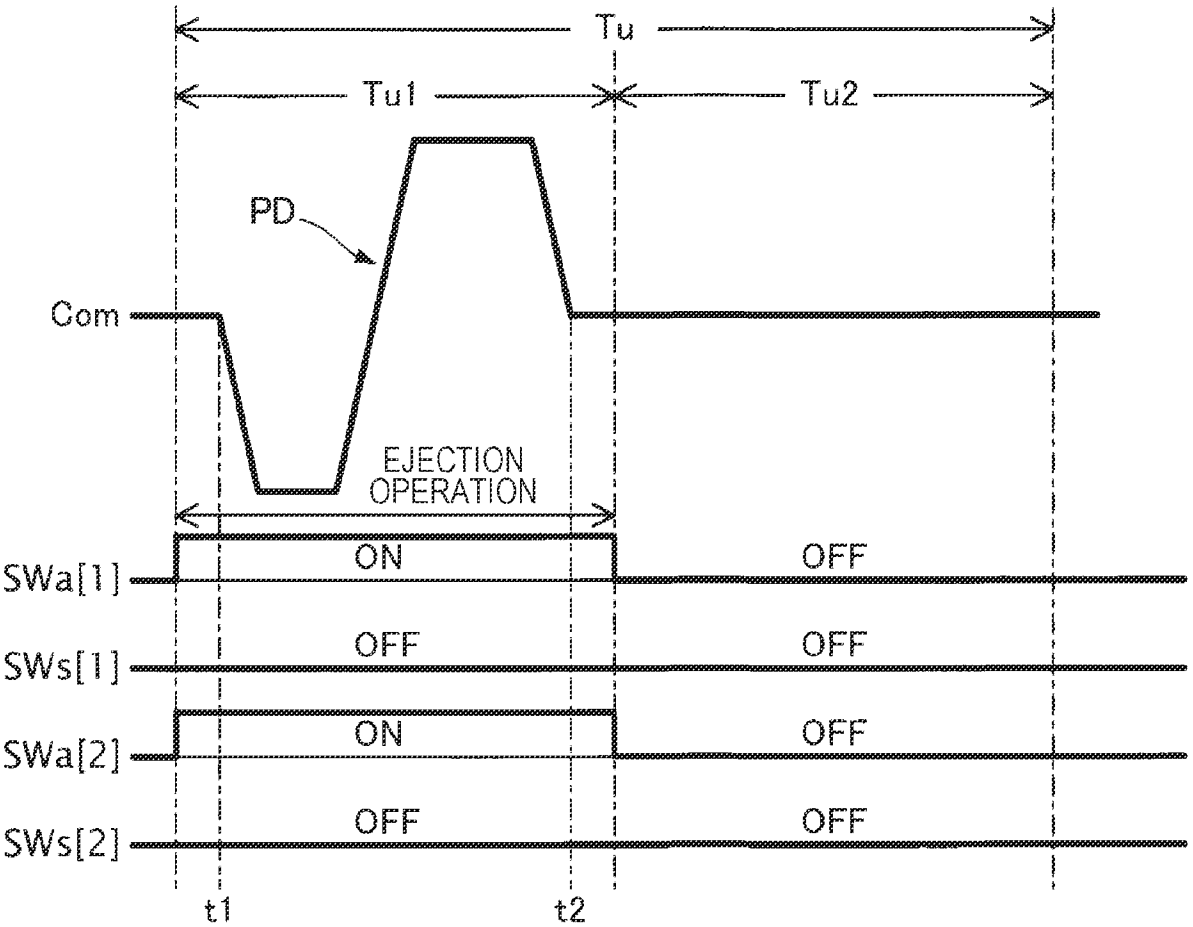
FIG. 6 is a diagram for explaining an ejection operation according to the first embodiment.

FIG. 6 is a diagram for explaining the ejection operation according to the first embodiment. As shown in FIG. 6, the drive signal Com includes a drive pulse PD and is repeated for a unit period Tu. The unit period Tu is divided into a preceding period Tu1 and a succeeding period Tu2. In the example shown in FIG. 6, the length of the period Tu1 and the length of the period Tu2 are equal to each other. In the embodiment, each of the period Tu1 and the period Tut is used as a control period for switching the switch SWa[1], the switch SWa[2], the switch SWs[1], and the switch SWs[2].

The switch SWa[1], the switch SWa[2], the switch SWs [1], and the switch SWs[2] may be switched in a control period shorter than the period Tu1 or the period Tu2. Further, the length of the period Tu1 and the length of the period Tu2 may be different from each other.

The drive pulse PD is included in the period Tu1 and is a pulse having a waveform over the period from first timing t1 to second timing t2. In the example shown in FIG. 6, the potential of the drive pulse PD, with the offset potential VBS as a reference potential, drops to a potential lower than the reference potential, and then rises to a potential higher than the reference potential. The drive pulse PD having such a waveform is more suitable for ejecting the ink from the nozzle N than that when the drive pulse PD is configured only by a potential higher than the reference potential. Note that FIG. 6 illustrates a case where the potential of the drive signal Com in the period Tu2 is a reference potential, but the present disclosure is not limited to this. The period Tu2 may appropriately include a pulse for ejection or inspection.

The control circuit 51 performs an ejection operation of ejecting the ink from the nozzle N at the time of printing or the like. In the ejection operation, the drive circuit 45 drives both the piezoelectric element 41[1] and the piezoelectric element 41[2], so that the ink is ejected from the nozzle N.

In the example shown in FIG. 6, each of the switch SWa[1] and the switch SWa[2] is turned on, and each of the switch SWs[1] and the switch SWs[2] is turned off over the period Tu1. Further, each of the switch SWa[1], the switch SWa[2], the switch SWs[1], and the switch SWs[2] is turned off over the period Tu2.

When the switches are turned on and off in this way, the drive pulse PD is applied to both the piezoelectric element 41[1] and the piezoelectric element 41[2] during the period Tu1. In the example shown in FIG. 6, since the drive signal Com does not include a pulse during the period Tu2, each of the switch SWa[1] and the switch SWa[2] may be turned on.

A7: Detection Operation of Liquid Ejection Apparatus

The control circuit 51 performs a detection operation in which the detection circuit 46 detects a change in the physical property of the ink flowing through the flow path provided in the liquid ejection head 24. The control circuit 51 of the present embodiment can perform the following first detection operation, second detection operation, and third detection operation as the detection operation. The selection or execution time of these detection operations is appropriately determined according to a preset program or an operation from the user.

Figure 7:
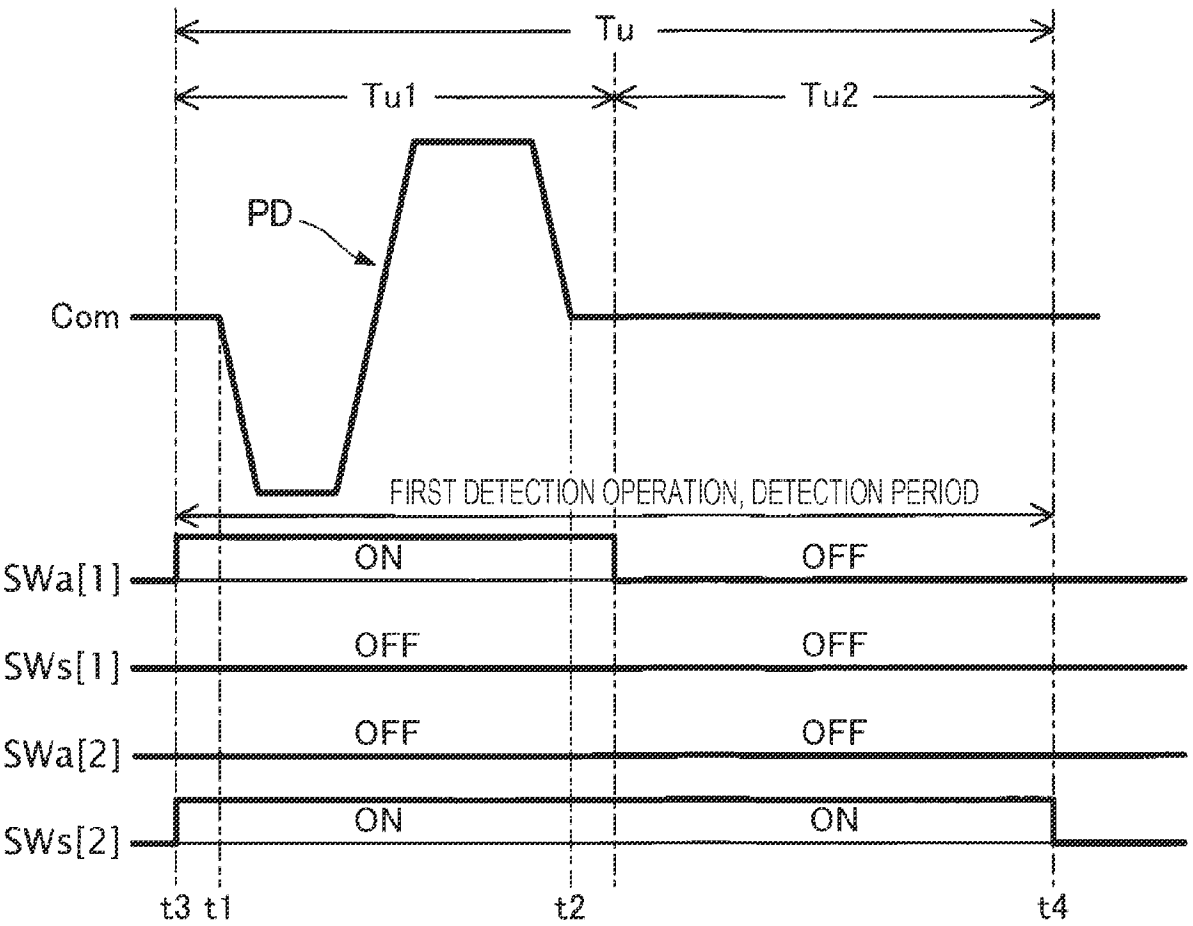
FIG. 7 is a diagram for explaining a first detection operation in the first embodiment.

FIG. 7 is a diagram for explaining the first detection operation in the first embodiment. In the first detection operation, the drive circuit 45 drives the piezoelectric element 41[1], and the detection circuit 46 detects the parameter accompanying the drive of the piezoelectric element 41[1]. The parameter detected by detection circuit 46 in the first detection operation is related to the physical property of the ink in the pressure chamber Cb. Here, the parameter is the residual vibration of the ink in the pressure chamber Cb.

In the example shown in FIG. 7, each of the switch SWa[1] and switch SWs[2] is turned on and each of the switch SWa[2] and the switch SWs[1] is turned off over the period Tu1. Further, the switch SWs[2] is turned on, and the switch SWa[1], the switch SWa[2], and the switch SWs[1] are turned off over the period Tu2.

When the switches are turned on and off in this way, the drive pulse PD is applied to the piezoelectric element 41[1] during the period Tu1, and the output signal Vout from the piezoelectric element 41[2] is input to the detection circuit 46 over the period Tu1 and the period Tu2.

Third timing t3, which is the detection start timing in the first detection operation, is before second timing t2, which is the end timing of the drive pulse PD. In the example shown in FIG. 7, third timing t3 is before first timing t1, which is the start timing of the drive pulse PD, and coincides with the start timing of the unit period Tu or the period Tut. Third timing t3 may be before second timing t2, and is not limited to the example shown in FIG. 7, but in order to suitably perform the first detection operation, third timing t3 is preferably before first timing t1.

Fourth timing t4, which is the end timing of the detection in the first detection operation, is after second timing t2, which is the end timing of the drive pulse PD. In the example shown in FIG. 7, fourth timing t4 coincides with the end timing of the unit period Tu or the period Tut. Fourth timing t4 may be after second timing t2, and is not limited to the example shown in FIG. 7.

Figure 8:
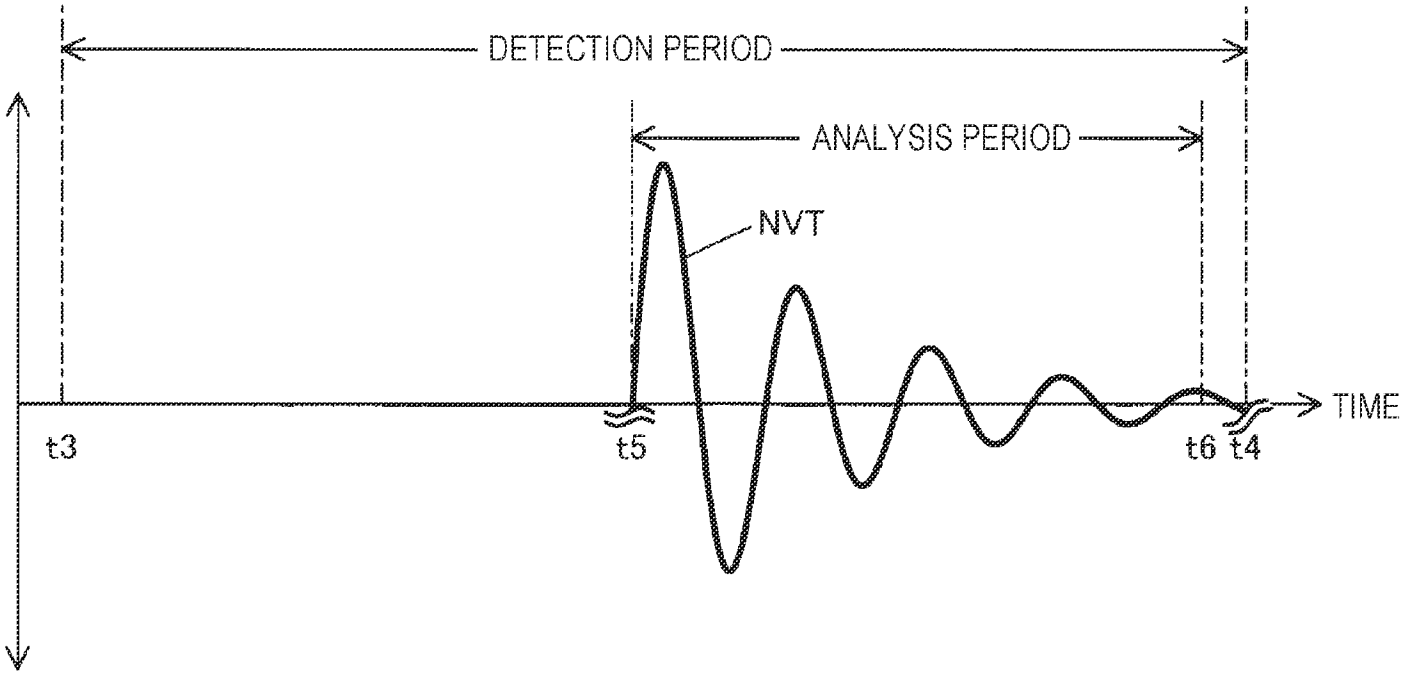
FIG. 8 is a diagram for explaining the relationship between the detection period and the analysis period.

FIG. 8 is a diagram for explaining the relationship between the detection period and the analysis period. As shown in FIG. 8, the output signal Vout including the residual vibration signal NVT is input to the detection circuit 46 during the detection period from third timing t3 to fourth timing t4.

The determination circuit 55 determines the ink ejection state of the nozzle N based on the residual vibration signal NVT over the analysis period from fifth timing t5 to sixth timing t6 within the detection period. Here, fifth timing t5 is second timing t2 or the timing immediately after that. Sixth timing t6 is the timing before fourth timing t4. Fifth timing t5 and sixth timing t6 are not limited to the example shown in FIG. 8, but any timing may be used.

The residual vibration signal NVT is a signal indicating a residual vibration. The residual vibration is a vibration of a natural frequency determined by the flow path resistance of the flow path through which the ink flows in the liquid ejection head 24, the inertance of the ink in the flow path, the elastic compliance of the diaphragm 35, and the like. Here, the residual vibration of the diaphragm 35 is equivalent to the residual vibration of the ink (liquid).

The determination circuit 55 determines the ejection state from the nozzle N based on the cycle or the amplitude of the residual vibration signal NVT. For example, the determination circuit 55 determines that when the cycle of the residual vibration signal NVT is equal to or greater than the reference value, air bubbles are mixed in the ink and the ejection state of the nozzle N is defective. Further, the determination circuit 55 determines that when the attenuation rate of the amplitude of the residual vibration signal NVT is equal to or higher than the reference value, the degree of thickening of the ink exceeds the permissible range and the ejection state of the nozzle N is defective.

Figure 9:
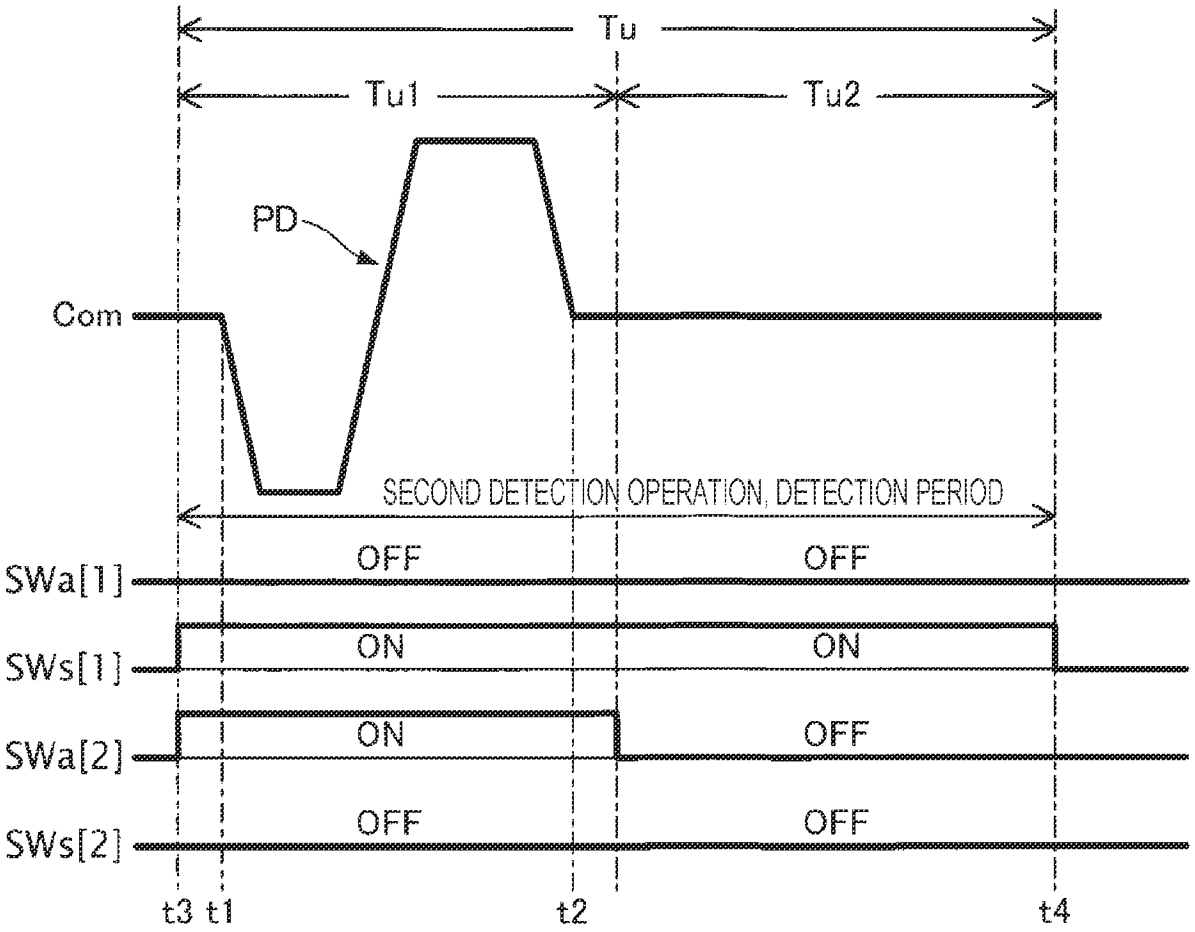
FIG. 9 is a diagram for explaining a second detection operation in the first embodiment.

The first embodiment may be a system in which only the above-mentioned first detection operation is performed, but a second detection operation may be further performed. FIG. 9 is a diagram for explaining the second detection operation. In the second detection operation, the drive circuit 45 drives the piezoelectric element 41[2], and the detection circuit 46 detects the parameter accompanying the drive of the piezoelectric element 41[2]. The parameter detected by detection circuit 46 in the second detection operation is related to the physical property of the ink in the pressure chamber Ca. Here, the parameter is the residual vibration of the ink in the pressure chamber Ca.

In the example shown in FIG. 9, each of the switch SWa[2] and the switch SWs[1] is turned on and each of the switch SWa[1] and the switch SWs[2] is turned off over the period Tu1. Further, the switch SWs[1] is turned on, and the switch SWa[1], the switch SWa[2], and the switch SWs[2] are turned off over the period Tut.

When the switches are turned on and off in this way, the drive pulse PD is applied to the piezoelectric element 41[2] during the period Tu1, and the output signal Vout from the piezoelectric element 41[1] is input to the detection circuit 46 over the period Tu1 and the period Tut.

The detection start timing in the second detection operation is the same as the start timing of the first detection operation, and is third timing t3. The detection end timing in the second detection operation is the same as the end timing of the first detection operation, and is fourth timing t4. The detection start timing in the second detection operation may be different from the detection start timing in the first detection operation. Similarly, the detection end timing in the second detection operation may be different from the detection end timing in the first detection operation.

The above second detection operation is performed for a period different from that of the above-mentioned first detection operation, that is, before or after the first detection operation. Then, the determination circuit 55 determines the ejection state of the ink from the nozzle N by using the detection results obtained by these detection operations. For example, the determination circuit 55 calculates the difference between the detection results obtained by these detection operations, and determines that the ink ejection state is abnormal such as an ejection failure when the difference is equal to or greater than a predetermined value. That is, the determination circuit 55 determines the presence or absence of an abnormality such as an ejection failure by using one of the detection results of these detection operations as a reference for the other. Here, the determination circuit 55 appropriately stores the detection results of these detection operations in the storage circuit 52 and reads them from the storage circuit 52.

Figure 10:
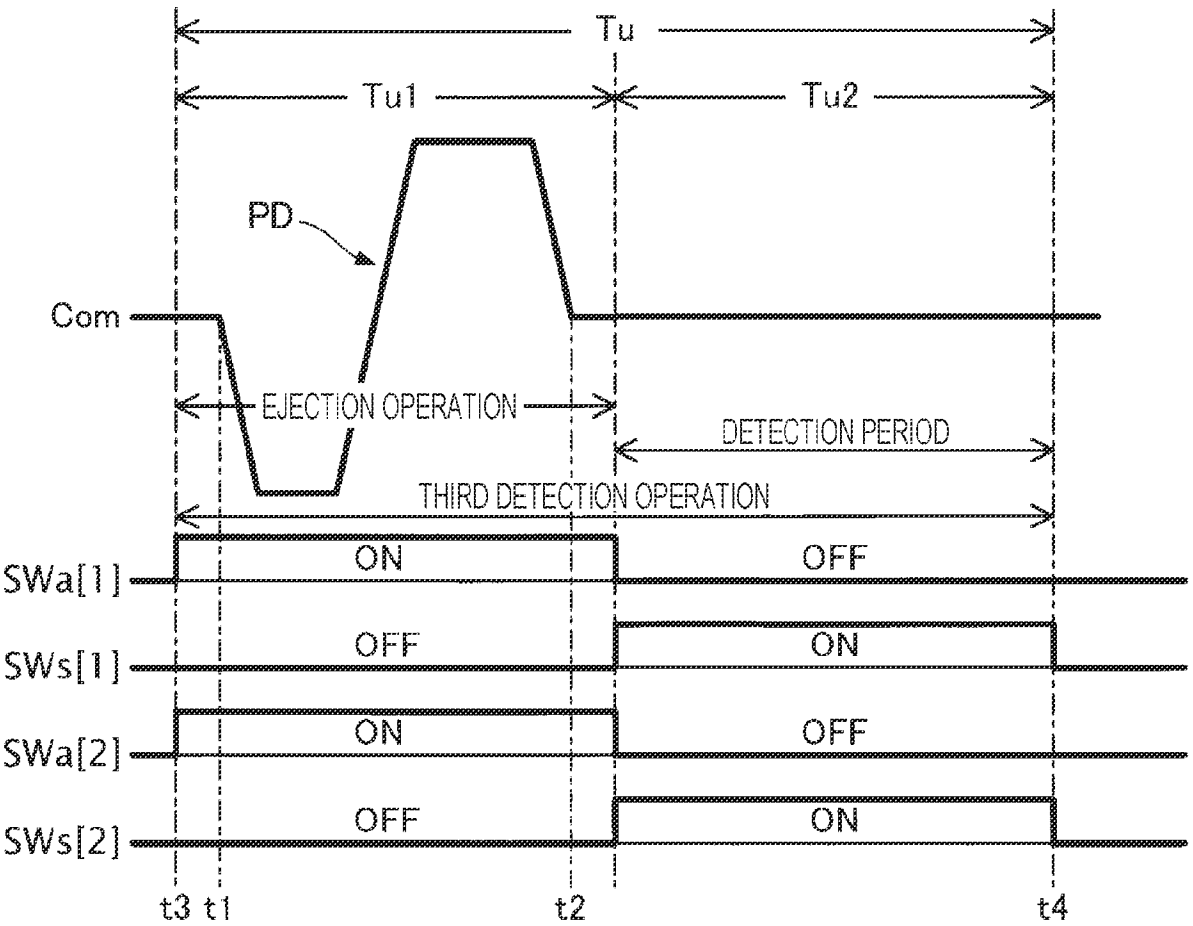
FIG. 10 is a diagram for explaining a third detection operation in the first embodiment.

The first embodiment may be a system in which only the above-mentioned first detection operation is performed, but a third detection operation may be further performed. FIG. 10 is a diagram for explaining the third detection operation in the first embodiment. In the third detection operation, the drive circuit 45 drives the piezoelectric element 41[1] and the piezoelectric element 41[2], and the detection circuit 46 detects a change in the physical property of the ink in the pressure chamber Ca and the pressure chamber Cb due to the driving of the piezoelectric element 41[1] and the piezoelectric element 41[2].

In the example shown in FIG. 10, each of the switch SWa[2] and the switch SWs[1] is turned on and each of the switch SWa[1] and the switch SWs[2] is turned off over the period Tu1. Further, each of the switch SWs[1] and the switch SWs[2] is turned on, and each of the switch SWa[1] and the switch SWa[2] is turned off over the period Tut.

When the switches are turned on and off in this way, the drive pulse PD is applied to the piezoelectric element 41[1] and the piezoelectric element 41[2] during the period Tu1, and the output signal Vout from the piezoelectric element 41[1] and the piezoelectric element 41[2] is input to the detection circuit 46 over the period Tut.

The detection start timing in the third detection operation is immediately after the above-mentioned second timing t2. The detection end timing in the third detection operation is the same as the end timing of the first detection operation, and is fourth timing t4. The detection start timing and end timing in the third detection operation are not limited to the example shown in FIG. 10. For example, the detection end timing in the third detection operation may be before fourth timing t4.

In the above third detection operation, as described above, both the piezoelectric element 41[1] and the piezoelectric element 41[2] are driven at the same time during the period Tu1, and the drive pulse PD same as that of the ejection operation described above is used, so that the ink is ejected from the nozzle N. Therefore, the third detection operation can be used instead of the ejection operation described above. Therefore, both printing and detection can be performed by using the third detection operation. Further, the detection result by the third detection operation may be used in combination with the detection result by the first detection operation or the second detection operation described above for the determination in the determination circuit 55. Here, the determination circuit 55 appropriately stores the detection results of these detection operations in the storage circuit 52 and reads them from the storage circuit 52.

As described above, the above liquid ejection head unit 10 includes the pressure chamber Ca, which is an example of the first pressure chamber, the pressure chamber Cb, which is an example of the second pressure chamber, the piezoelectric element 41[1], which is an example of the first energy generating element, the piezoelectric element 41[2], which is an example of the second energy generating element, the nozzle flow path Nf, the drive circuit 45, the detection circuit 46, and the control circuit 51, which is an example of the controller.

Each of the pressure chamber Ca and the pressure chamber Cb applies pressure to the ink, which is an example of a liquid. The piezoelectric element 41[1] generates energy that applies pressure to the ink in the pressure chamber Ca. The piezoelectric element 41[2] generates energy that applies pressure to the ink in the pressure chamber Cb. The nozzle flow path Nf communicates the pressure chamber Ca and the pressure chamber Cb, and the nozzle flow path Nf has the nozzle N that ejects the ink. The drive circuit 45 drives the piezoelectric element 41[1] and the piezoelectric element 41[2] by applying the drive pulse PD. The detection circuit 46 detects the parameter related to the physical property of the ink in at least one of the pressure chamber Ca and the pressure chamber Cb. The control circuit 51 controls the operations of the drive circuit 45 and the detection circuit 46.

Specifically, the control circuit 51 drives the piezoelectric element 41[1] by the drive circuit 45, and performs the first detection operation in which the detection circuit 46 detects the parameter related to the physical property of the ink in the pressure chamber Cb accompanying the drive of the piezoelectric element 41[1].

In the above liquid ejection head unit 10, the parameter related to the physical property of the ink in the pressure chamber Cb accompanying the driving of the piezoelectric element 41[1] is detected in the first detection operation, so that it is not necessary to use the piezoelectric element 41[1] for the detection. Therefore, it is not necessary to switch the piezoelectric element 41[2], which is an element used for the detection, from the driving state to the detecting state, and it is possible to prevent noise from being mixed in the detection waveform due to the switching. As a result, the determination accuracy of the ejection state can be improved, compared with that of a liquid ejection head unit in the related art.

Here, the control circuit 51 performs an ejection operation of ejecting the ink from the nozzle N by driving both the piezoelectric element 41[1] and the piezoelectric element 41[2] by the drive circuit 45. Such an ejection operation can improve the ejection efficiency, compared with the operation of ejecting the ink from the nozzle N by driving either the piezoelectric element 41[1] or the piezoelectric element 41[2]. Further, the drive pulse PD by which the ink is not ejected from the nozzle N when driving one of the piezoelectric element 41[1] and the piezoelectric element 41[2] can be used for the ejection operation. Therefore, the first detection operation and the ejection operation have the same drive pulse PD.

In the present embodiment, the drive pulse PD applied to the piezoelectric element 41[1] in the first detection operation has the same waveform as the drive pulse PD applied to the piezoelectric element 41[1] in the ejection operation. Therefore, the configuration of the liquid ejection head unit 10 can be simplified, compared with the configuration in which different drive pulses are used for the first detection operation and the ejection operation. Here, it is possible to prevent the ink from being ejected from the nozzle N in the first detection operation by appropriately setting the waveform of the drive pulse PD.

It is preferable that the ink be not ejected from the nozzle N in the first detection operation. In this case, when the first detection operation is used as a detection-only operation, the waste of ink can be reduced.

As described above, in the first detection operation, the drive circuit 45 applies the drive pulse PD to the piezoelectric element 41[1]. Here, the drive pulse PD is a waveform over a period from first timing t1 to second timing t2. In the first detection operation, the detection circuit 46 detects a change in the physical property of the ink in the pressure chamber Cb over a period from third timing t3 before second timing t2. Therefore, the change in the physical property of the ink in the pressure chamber Cb due to the driving of the piezoelectric element 41[1] can be detected from the start of its generation.

Further, in the first detection operation, the detection circuit 46 detects the change in the physical property of the ink in the pressure chamber Cb over the period until fourth timing t4 after second timing t2. Therefore, the parameter related to the physical property of the ink in the pressure chamber Cb accompanying the driving of the piezoelectric element 41[1] can be detected from the start of its generation over the range necessary for determination.

In the present embodiment, the detection circuit 46 detects a residual vibration generated in the pressure chamber Cb as a parameter related to the physical property. After driving the piezoelectric element 41[1], a residual vibration is generated as a vibration remaining in the pressure chamber Cb as the pressure of the ink in the pressure chamber Ca changes. For example, the amplitude or the cycle of this residual vibration differs depending on the presence or absence of air bubbles generated in the ink in the pressure chamber Cb, the degree of thickening, and the like. Therefore, the ejection state of the nozzle N can be determined by using the detection result by detecting the residual vibration.

As described above, the liquid ejection head unit 10 further includes the determination circuit 55, which is an example of the determination unit. The determination circuit 55 determines the ejection state of the ink from the nozzle N based on the detection result of the parameter related to the physical property by the first detection operation. Therefore, it is possible to control the ejection of the ink from the nozzle N so as to improve the image quality, or to make a notification of the ejection state of the ink from the nozzle N using the determination result of the determination circuit 55.

Here, in the present embodiment, as described above, the control circuit 51 performs not only the first detection operation but also the second detection operation. In the second detection operation, the drive circuit 45 drives the piezoelectric element 41[2], and the detection circuit 46 detects the parameter related to the physical property of the ink in the pressure chamber Ca accompanying the drive of the piezoelectric element 41[2]. The determination circuit 55 determines the ejection state of the ink from the nozzle N based on the detection result of the first detection operation and the detection result of the second detection operation. For example, by using the difference between the detection result by the first detection operation and the detection result by the second detection operation, it can be determined that the ink ejection state is abnormal such as an ejection failure when the difference is equal to or more than a predetermined value. In addition, the difference can be used to cancel or reduce unnecessary components such as noise contained in these detection results. Therefore, the determination accuracy of the ejection state of the ink from the nozzle N can be improved, compared with the determination accuracy when only the detection result by the first detection operation is used. The second detection operation may be performed as needed. Further, the control circuit 51 may not perform the second detection operation.

Further, as described above, the control circuit 51 may perform the third detection operation in addition to the first detection operation and the second detection operation. In the third detection operation, the drive circuit 45 drives the piezoelectric element 41[1], and the detection circuit 46 detects the parameter related to the physical property of the ink in the pressure chamber Ca accompanying the drive of the piezoelectric element 41[1]. Therefore, the detection accuracy in the detection circuit 46 can be improved by using the detection result by at least one of the first detection operation and the second detection operation and the detection result by the third detection operation in combination.

Here, in addition to the above-mentioned operation, in the third detection operation, it is preferable that the drive circuit 45 drive the piezoelectric element 41[2], and the detection circuit 46 detect the parameter related to the physical property of the ink in the pressure chamber Cb accompanying the drive of the piezoelectric element 41[2]. In this case, as in the case of using the detection result by the first detection operation and the detection result by the second detection operation in combination, by using the difference between the two detection results using the third detection operation, the determination accuracy of the determination circuit 55 can be improved. The third detection operation may be performed as needed. Further, the control circuit 51 may not perform the third detection operation.

As described above, the drive circuit 45 also functions as a switching circuit. That is, the liquid ejection head unit 10 includes the drive circuit 45, which is an example of the switching circuit capable of switching between the first state and the second state. In the first state, the piezoelectric element 41[2] and the drive circuit 45 are electrically coupled, and the piezoelectric element 41[2] and the detection circuit 46 are not electrically coupled. Therefore, when the drive circuit 45 is in the first state, the piezoelectric element 41[2] can be used as the drive element in the ejection operation. On the other hand, in the second state, the piezoelectric element 41[2] and the drive circuit 45 are not electrically coupled, and the piezoelectric element 41[2] and the detection circuit 46 are electrically coupled. Therefore, when the drive circuit 45 is in the second state, the piezoelectric element 41[2] can be used as the detection element in the first detection operation.

The liquid ejection apparatus 100 described above includes the liquid ejection head unit 10 and the transport mechanism 22 that transports the medium 11, which is an example of the print medium on which an image by the ink from the nozzle N is printed. In the above liquid ejection apparatus 100, by using the excellent detection characteristics of the liquid ejection head unit 10 as described above, it is possible to improve the image quality and the reliability, compared with a liquid ejection head unit in the related art.

B: Second Embodiment

Hereinafter, the second embodiment of the present disclosure will be described. In the embodiment illustrated below, elements having the same actions and functions as those of the first embodiment will be denoted by the reference numerals used in the description of the first embodiment, and detailed description thereof will be appropriately omitted.

Figure 11:
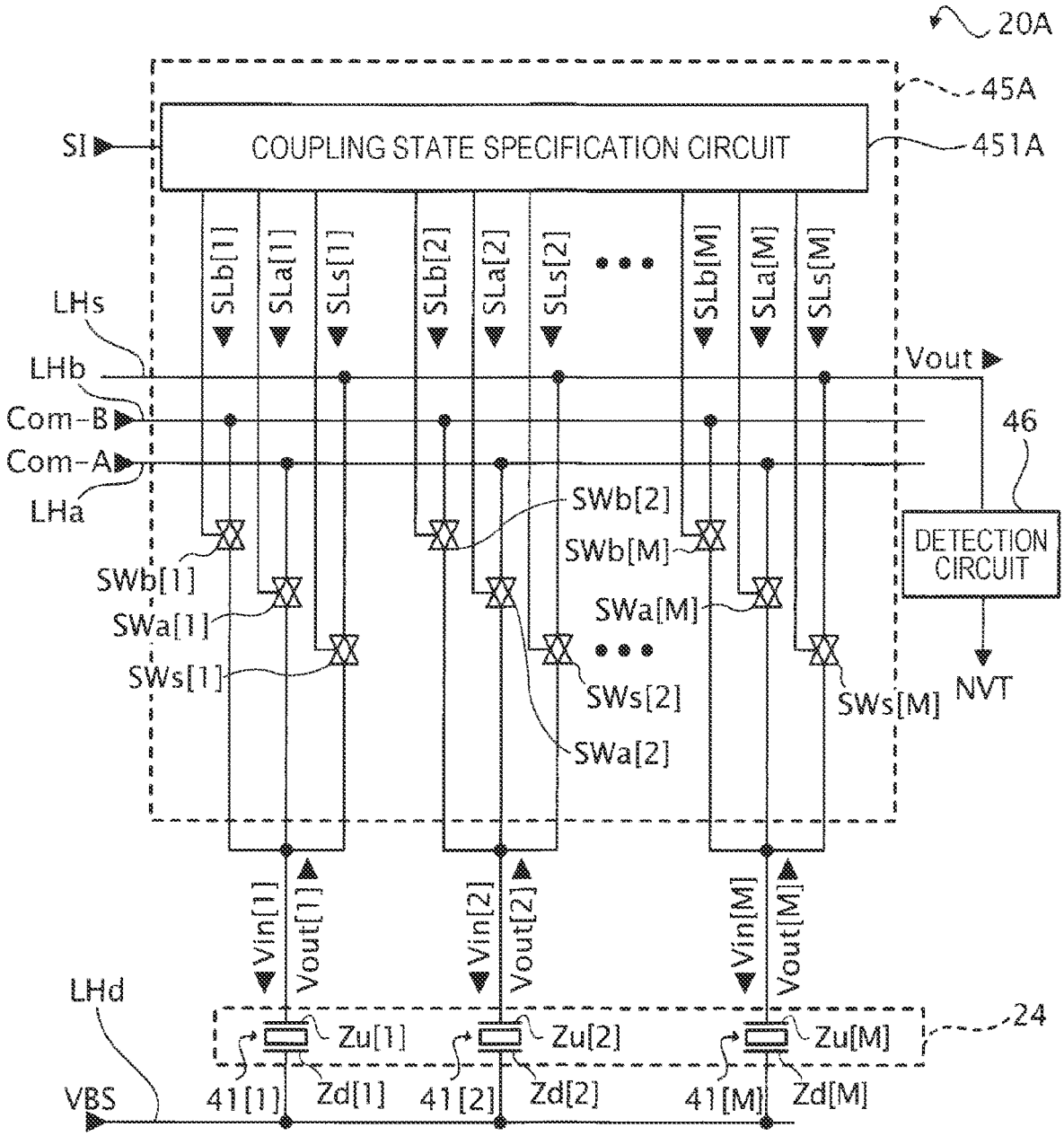
FIG. 11 is a diagram showing a configuration example of a drive circuit according to the second embodiment.

FIG. 11 is a diagram showing a configuration example of a drive circuit 45A according to the second embodiment. A liquid ejection head unit 10A of the present embodiment includes the drive circuit 45A shown in FIG. 11 in place of the drive circuit 45 of the liquid ejection head unit 10 of the first embodiment described above.

As shown in FIG. 11, in addition to the wirings LHd, LHa and LHs, wiring LHb is coupled to the drive circuit 45A. The wiring LHb is a signal line for transmitting a drive signal Com-B. In the present embodiment, the wiring LHa is a signal line for transmitting a drive signal Com-A.

The drive circuit 45A includes M switches SWa (SWa[1] to SWa[M]), M switches SWb (SWb[1] to SWb[M]), M switches SWs (SWs[1] to SWs[M]), and a coupling state specification circuit 451A that specifies the coupling state of these switches.

The switch SWb[m] is a switch that switches between conduction (on) and non-conduction (off) between the wiring LHb and the piezoelectric element 41[*m*]. The coupling state specification circuit 451A generates, based on the control signal SI, coupling state specification signals SLb[1] to SLb[M] that specify the on/off of the switches SWb[1] to SWb[M], in addition to the coupling state specification signals SLa[1] to SLa[M] and the coupling state specification signals SLs[1] to SWs[M].

The switch SWb[m] is turned on and off according to the coupling state specification signal SLb[m]. As described above, the drive circuit 45A supplies part or all of the waveform included in the drive signal Com-B as the supply drive signal Vin to one or a plurality of piezoelectric elements 41 selected from the plurality of piezoelectric elements 41.

Figure 12:
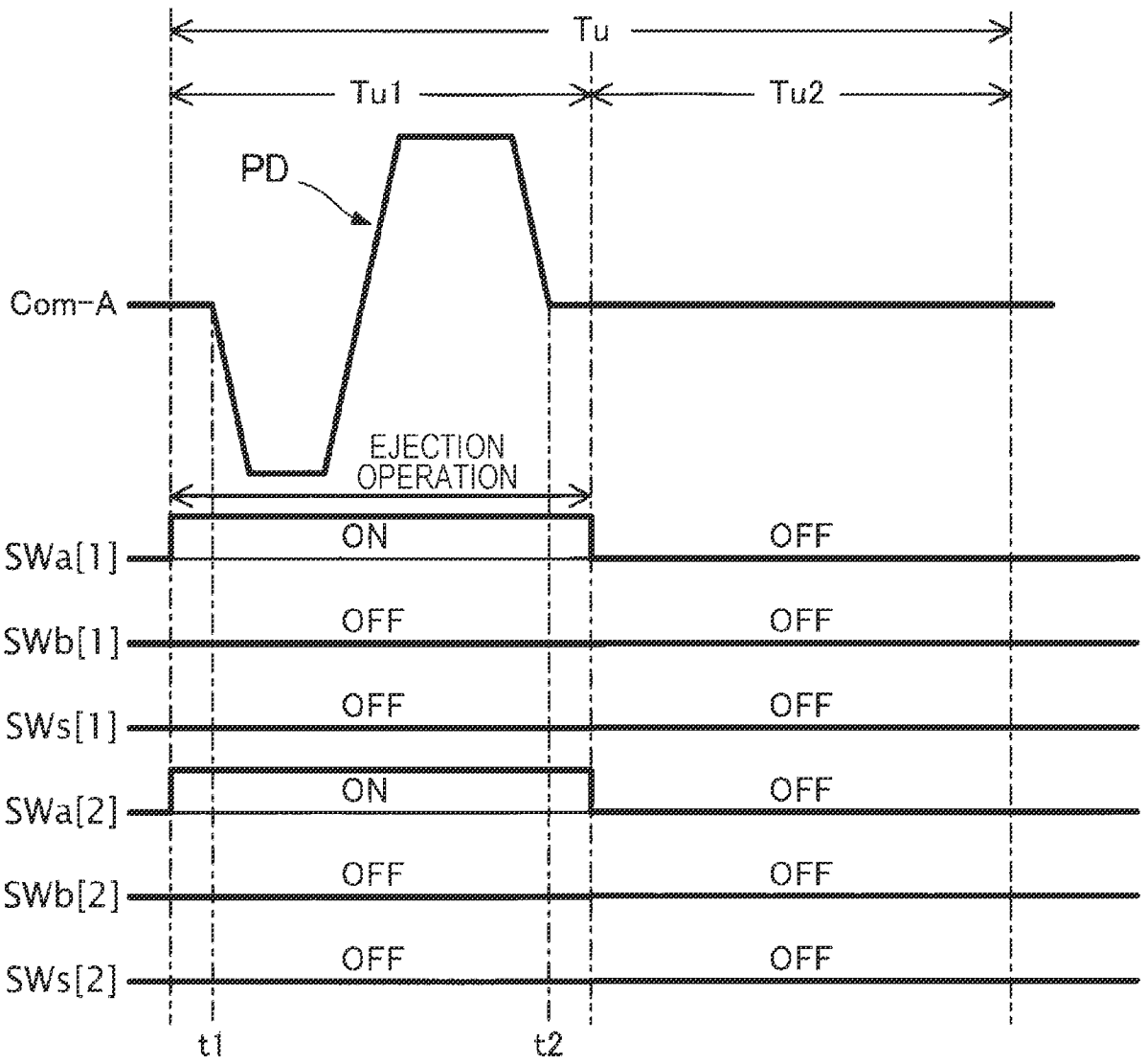
FIG. 12 is a diagram for explaining an ejection operation according to the second embodiment.

FIG. 12 is a diagram for explaining the ejection operation according to the second embodiment. As shown in FIG. 12, the drive signal Com-A includes the drive pulse PD, as in the drive signal Com of the first embodiment described above, and is repeated for the unit period Tu.

In the ejection operation, the drive circuit 45 applies the drive pulse PD to both the piezoelectric element 41[1] and the piezoelectric element 41[2] as in the first embodiment described above.

In the example shown in FIG. 12, each of the switch SWa[1] and the switch SWa[2] is turned on and each of the switch SWb[1], the switch SWb[2], the switch SWs[1] and the switch SWs[2] is turned off over the period Tu1. Further, each of the switch SWa[1], the switch SWa[2], the switch SWb[1], the switch SWb[2], the switch SWs[1], and the switch SWs[2] is turned off over the period Tu2.

Figure 13:
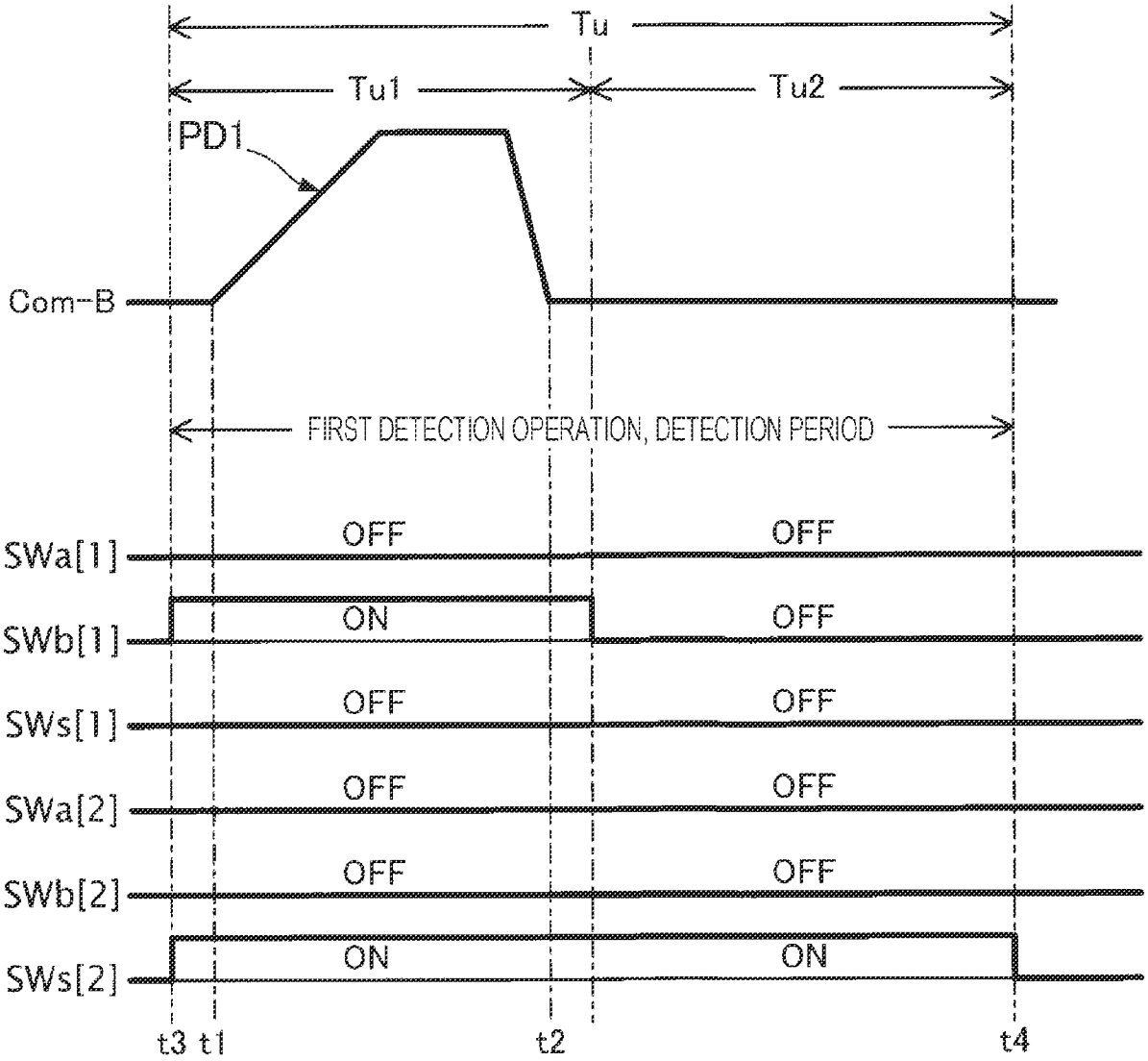
FIG. 13 is a diagram for explaining a first detection operation in the second embodiment.

FIG. 13 is a diagram for explaining the first detection operation in the second embodiment. As shown in FIG. 13, the drive signal Com-B includes a drive pulse PD1 and is repeated for the unit period Tu. As in the first embodiment, the unit period Tu is divided into the preceding period Tu1 and the succeeding period Tu2.

The drive pulse PD1 is included in the period Tu1 and is a pulse having a waveform over a period from first timing t1 to second timing t2. However, the waveform of the drive pulse PD1 is different from that of the drive pulse PD. In the example shown in FIG. 13, the potential of the drive pulse PD1, with the offset potential VBS as a reference potential, does not drop to a potential lower than the reference potential, and rises to a potential higher than the reference potential. The drive pulse PD1 having such a waveform is likely not to eject the ink from the nozzle N, compared with the drive pulse PD. Therefore, in the first detection operation, it is possible to suppress the waste of the ink without ejecting the ink from the nozzle N.

In the first detection operation of the embodiment, the drive circuit 45 applies the drive pulse PD1 to the piezoelectric element 41[1], and the detection circuit 46 detects the parameter related to the physical property of the ink in the pressure chamber Cb that accompanies the driving of the piezoelectric element 41[1].

In the example shown in FIG. 13, each of the switch SWb[1] and the switch SWs[2] is turned on and each of the switch SWa[1], the switch SWa[2], the switch SWb[2] and the switch SWs[1] is turned off over the period Tut. In addition, the switch SWs[2] is turned on and each of the switch SWa[1], the switch SWa[2], the switch SWb[1], the switch SWb[2], and the switch SWs[1] is turned off over the period Tut.

The above-mentioned second embodiment has the same effect as the above-mentioned first embodiment. Further, in the present embodiment, by using the drive pulse PD1 in the first detection operation, the ink is likely not to be ejected from the nozzle N in the first detection operation.

C: Third Embodiment

Hereinafter, the third embodiment of the present disclosure will be described. In the embodiment illustrated below, elements having the same actions and functions as those of the first embodiment will be denoted by the reference numerals used in the description of the first embodiment, and detailed description thereof will be appropriately omitted.

Figure 14:
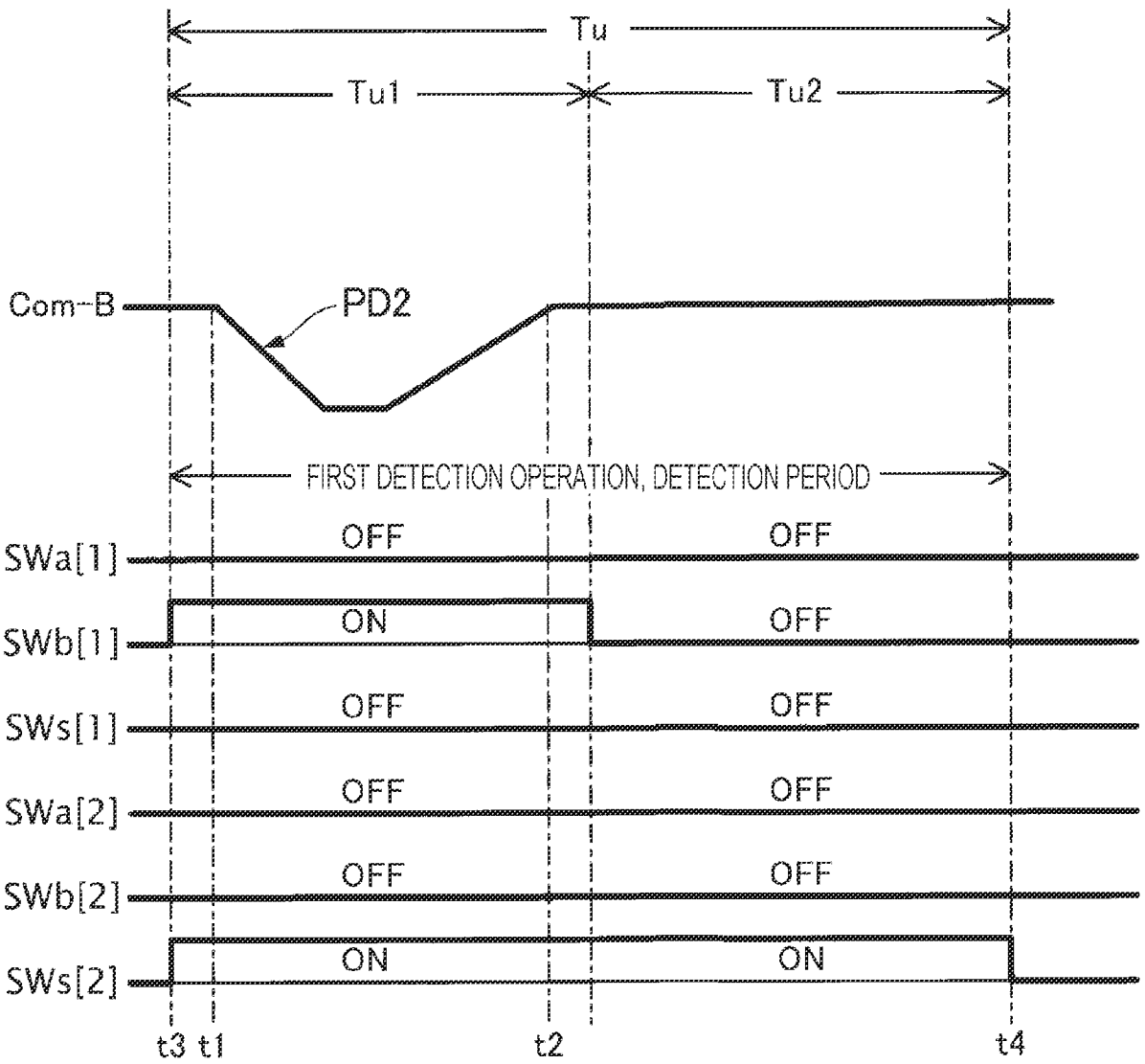
FIG. 14 is a diagram for explaining a first detection operation in the third embodiment.

FIG. 14 is a diagram for explaining the first detection operation in the third embodiment. The present embodiment is the same as the above-described second embodiment except that the drive signal Com-B including a drive pulse PD2 instead of the drive pulse PD1 is used.

The drive pulse PD2 is included in the period Tut and is a pulse having a waveform over a period from first timing t1 to second timing t2. In the example shown in FIG. 14, the potential of the drive pulse PD2, with the offset potential VBS as a reference potential, does not rise to a potential higher than the reference potential, and drops to a potential lower than the reference potential. As in the drive pulse PD1 of the second embodiment described above, the drive pulse PD2 having such a waveform is likely not to eject the ink from the nozzle N, compared with the drive pulse PD. Therefore, in the first detection operation, it is possible to suppress the waste of the ink without ejecting the ink from the nozzle N.

The above-mentioned third embodiment has the same effect as the above-mentioned first embodiment. Further, in the present embodiment, by using the drive pulse PD2 in the first detection operation, the ink is likely not to be ejected from the nozzle N in the first detection operation.

D: Modifications

Each of the embodiments can be variously modified. Specific modifications that can be applied to the above-described embodiments are described below. The forms selected from the following modifications can be appropriately combined to the extent that they do not contradict each other.

Modification 1

In each of the above-described embodiments, a configuration in which the ink used for the liquid ejection head is circulated by a circulation mechanism is exemplified, but the configuration is not limited to this configuration. The configuration without such a circulation mechanism may be used.

Modification 2

Each of the first energy generating element and the second energy generating element that changes the pressure of the ink in the pressure chamber C is not limited to the piezoelectric element 41 exemplified in each of the above-described embodiments. For example, a heat generating element that fluctuates the pressure of the ink by generating air bubbles inside the pressure chamber C by heating may be used as the first energy generating element or the second energy generating element.

When the heat generating element is used as the first energy generating element and the second energy generating element, the detection circuit 46 preferably detects the temperature as a parameter related to the physical property of the ink. The viscosity of the ink changes with a change in temperature. Therefore, the first energy generating element can be driven, the temperature in the second pressure chamber at this time can be detected by the second energy generating element, and the viscosity, which is the physical property of the ink, can be estimated from the temperature change. Specifically, in the configuration in which the heat generating element is used as the first energy generating element, the temperature of the liquid in the second pressure chamber rise as the temperature of the liquid in the first pressure chamber rises by driving the first energy generating element. Further, after driving the first energy generating element, the temperature of the liquid in the second pressure chamber drops so as to return to a steady state. The temperature change of the liquid in the second pressure chamber differs depending on the presence or absence of air bubbles generated in the liquid in the second pressure chamber, the degree of thickening, or the like. Therefore, it is possible to determine the presence or absence of air bubbles in the liquid in the second pressure chamber, the degree of thickening, and the like by using the detection result by detecting the temperature in the second pressure chamber.

Modification 3

In each of the above embodiments, although the serial type liquid ejection apparatus 100 that reciprocates the transport body 231 on which the liquid ejection head 24 is mounted has been illustrated, the present disclosure also applies to a line-type liquid ejection apparatus in which a plurality of nozzles N is distributed over the entire width of the medium 11.

The liquid ejection apparatus 100 illustrated in the above-described embodiments may be used in various devices such as a facsimile machine and a copier, in addition to a device dedicated to printing, and the application of the present disclosure is not particularly limited. The application of the liquid ejection apparatus is not limited to printing. For example, a liquid ejection apparatus that ejects a solution of a coloring material is used as a manufacturing device that forms a color filter for a display device such as a liquid crystal display panel. Further, a liquid ejection apparatus that ejects a solution of a conductive material is used as a manufacturing device that forms wiring on a wiring substrate and electrodes. Further, a liquid ejection apparatus that ejects a solution of an organic substance related to a living body is used, for example, as a manufacturing device that manufactures a biochip.

What is claimed is:

1. A liquid ejection head unit comprising: a first pressure chamber that applies pressure to a liquid;

a second pressure chamber that applies pressure to a liquid;

a first energy generating element that generates energy that applies pressure to a liquid in the first pressure chamber;

a second energy generating element that generates energy that applies pressure to a liquid in the second pressure chamber;

a nozzle flow path which communicates the first pressure chamber and the second pressure chamber and in which a nozzle that ejects a liquid is provided;

a drive circuit that drives the first energy generating element and the second energy generating element by applying a drive pulse;

a detection circuit that detects a parameter related to a physical property of a liquid at least in the second pressure chamber; and a controller that controls an operation of the drive circuit and an operation of the detection circuit, wherein the controller drives the first energy generating element by the drive circuit, and performs a first detection operation of detecting the parameter in the second pressure chamber by the detection circuit.

2. The liquid ejection head unit according to claim 1, wherein the controller performs an ejection operation of ejecting a liquid from the nozzle by driving both the first energy generating element and the second energy generating element by the drive circuit.

3. The liquid ejection head unit according to claim 2, wherein a drive pulse applied to the first energy generating element in the first detection operation has the same waveform as a drive pulse applied to the first energy generating element in the ejection operation.

4. The liquid ejection head unit according to claim 1, wherein a liquid is not ejected from the nozzle in the first detection operation.

5. The liquid ejection head unit according to claim 1, wherein in the first detection operation, when a drive pulse having a waveform over a period from first timing to second timing is applied to the first energy generating element by the drive circuit, the parameter in the second pressure chamber is detected by the detection circuit over a period from third timing before the second timing.

6. The liquid ejection head unit according to claim 5, wherein the third timing is before the first timing.

7. The liquid ejection head unit according to claim 5, wherein in the first detection operation, the parameter in the second pressure chamber is detected by the detection circuit over a period until fourth timing after the second timing.

8. The liquid ejection head unit according to claim 1, wherein the detection circuit detects a residual vibration generated in the second pressure chamber as a parameter.

9. The liquid ejection head unit according to claim 1, wherein the detection circuit detects a temperature in the second pressure chamber as a parameter.

10. The liquid ejection head unit according to claim 1, wherein the physical property is viscosity of a liquid.

11. The liquid ejection head unit according to claim 1, further comprising:

a determination unit that determines an ejection state of a liquid from the nozzle based on the parameter or the physical property.

12. The liquid ejection head unit according to claim 11, wherein the controller drives the second energy generating element by the drive circuit, and performs a second detection operation of detecting the parameter in the first pressure chamber by the detection circuit, and wherein the determination unit determines an ejection state of a liquid from the nozzle based on a detection result of the first detection operation and a detection result of the second detection operation.

13. The liquid ejection head unit according to claim 1, further comprising:

a supply flow path that communicates with the first pressure chamber and through which a liquid is supplied to the first pressure chamber; and a discharge flow path that communicates with the second pressure chamber and through which a liquid is discharged from the second pressure chamber.

14. The liquid ejection head unit according to claim 1, further comprising:

a supply flow path that communicates with the second pressure chamber and through which a liquid is supplied to the second pressure chamber; and a discharge flow path that communicates with the first pressure chamber and through which a liquid is discharged from the first pressure chamber.

15. The liquid ejection head unit according to claim 1, wherein the controller performs a third detection operation in which the drive circuit drives the first energy generating element, and the detection circuit detects the parameter in the first pressure chamber accompanying a drive of the first energy generating element.

16. The liquid ejection head unit according to claim 15, wherein in the third detection operation, the second energy generating element is driven by the drive circuit, and the parameter in the second pressure chamber accompanying the driving of the second energy generating element is detected by the detection circuit.

17. The liquid ejection head unit according to claim 1, further comprising:

a switching circuit configured to switch between a first state in which the second energy generating element and the drive circuit are electrically coupled, and the second energy generating element and the detection circuit are not electrically coupled, and a second state in which the second energy generating element and the drive circuit are not electrically coupled, and the second energy generating element and the detection circuit are electrically coupled.

18. The liquid ejection head unit according to claim 1, wherein the first pressure chamber and the second pressure chamber each extend in an extending direction, and wherein the drive circuit is located between the first energy generating element and the second energy generating element in the extending direction.

19. A liquid ejection apparatus comprising:

the liquid ejection head unit according to claim 1; and a transport mechanism that transports a print medium on which an image by a liquid from the liquid ejection head unit is printed.

20. A method of determining a liquid ejection state of a liquid ejection apparatus including a first pressure chamber that applies pressure to a liquid, a second pressure chamber that applies pressure to a liquid, a first energy generating element that generates energy that applies pressure to a liquid in the first pressure chamber, a second energy generating element that generates energy that applies pressure to a liquid in the second pressure chamber, and a nozzle flow path which communicates the first pressure chamber and the second pressure chamber and in which a nozzle that ejects a liquid is provided, the method comprising:

driving the first energy generating element to detect a parameter related to a physical property of a liquid in the second pressure chamber accompanying a drive of the first energy generating element; and determining an ejection state of a liquid from the nozzle based on the parameter and the physical property.

* * * * *